US009165422B2

(12) United States Patent
Barclay et al.

(10) Patent No.: US 9,165,422 B2
(45) Date of Patent: Oct. 20, 2015

(54) CONTROLLING GROUP WAGERING GAMES

(75) Inventors: Brian J. Barclay, Atlanta, GA (US); Andrew C. Guinn, Chicago, IL (US); Richard B. Robbins, Glenview, IL (US)

(73) Assignee: WMS Gaming, Inc., Waukegan, IL (US)

( * ) Notice: Subject to any disclaimer, the term of this patent is extended or adjusted under 35 U.S.C. 154(b) by 399 days.

(21) Appl. No.: 13/643,442

(22) PCT Filed: Apr. 26, 2011

(86) PCT No.: PCT/US2011/033996

§ 371 (c)(1),
(2), (4) Date: Oct. 25, 2012

(87) PCT Pub. No.: WO2011/139716

PCT Pub. Date: Nov. 10, 2011

(65) Prior Publication Data

US 2013/0040730 A1 Feb. 14, 2013

Related U.S. Application Data

(60) Provisional application No. 61/327,878, filed on Apr. 26, 2010.

(51) Int. Cl.
*G07F 17/32* (2006.01)

(52) U.S. Cl.
CPC ..... *G07F 17/3225* (2013.01); *G07F 17/3223* (2013.01); *G07F 17/3274* (2013.01); *G07F 17/3276* (2013.01); *G07F 17/32* (2013.01)

(58) Field of Classification Search
None
See application file for complete search history.

(56) References Cited

U.S. PATENT DOCUMENTS

| | | | | |
|---|---|---|---|---|
| 7,343,335 | B1 | 3/2008 | Olliphant | |
| 8,401,968 | B1 * | 3/2013 | Schattauer et al. | 705/44 |
| 8,613,655 | B2 * | 12/2013 | Kisenwether et al. | 463/21 |
| 2006/0281541 | A1 | 12/2006 | Nguyen et al. | |
| 2007/0093298 | A1 * | 4/2007 | Brunet | 463/42 |
| 2007/0136817 | A1 * | 6/2007 | Nguyen | 726/26 |
| 2007/0167210 | A1 | 7/2007 | Kelly et al. | |
| 2008/0020834 | A1 | 1/2008 | Breckner et al. | |
| 2008/0167106 | A1 | 7/2008 | Lutnick et al. | |
| 2008/0234047 | A1 * | 9/2008 | Nguyen | 463/42 |
| 2009/0275411 | A1 * | 11/2009 | Kisenwether et al. | 463/42 |
| 2009/0325686 | A1 | 12/2009 | Davis et al. | |
| 2010/0048302 | A1 | 2/2010 | Lutniek et al. | |

OTHER PUBLICATIONS

"PCT Application No. PCT/US11/33996 International Preliminary Report on Patentability", Aug. 24, 2012, 7 pages.
"PCT Application No. PCT/US11/33996 International Search Report", Oct. 18, 2011, 10 pages.

* cited by examiner

*Primary Examiner* — Bach Hoang
(74) *Attorney, Agent, or Firm* — DeLizio Law, PLLC

(57) ABSTRACT

A wagering game system and its operations are described herein. In embodiments, the operations can include detecting a user request to initiate a group wagering game from a host wagering game player account, via a local-area networking device at a non-casino geographic location and providing group wagering game content to the local-area networking device in response to the request. The operations can further include detecting wagering activity from members of a group at the geographic location, providing wagering game outcome information related to the wagering activity, and assigning a portion of the wagering activity to the host wagering game player account.

23 Claims, 10 Drawing Sheets

CONTROLLING GROUP WAGERING GAMES

RELATED APPLICATIONS

This application claims the priority benefit of U.S. Provisional Application Ser. No. 61/327,878 filed Apr. 26, 2010.

LIMITED COPYRIGHT WAIVER

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2011, WMS Gaming, Inc.

TECHNICAL FIELD

Embodiments of the inventive subject matter relate generally to wagering game systems and networks that, more particularly, control group wagering games.

BACKGROUND

Wagering game machines, such as slot machines, video poker machines and the like, have been a cornerstone of the gaming industry for several years. Traditionally, wagering game machines have been confined to physical buildings, like casinos (e.g., resort casinos, road-side casinos, etc.). The casinos are located in specific geographic locations that are authorized to present wagering games to casino patrons. However, with the proliferation of interest and use of the Internet, shrewd wagering game manufacturers have recognized that a global public network, such as the Internet, can reach to various locations of the world that have been authorized to present wagering games. Any individual with a personal computing device (e.g., a personal computer, a laptop, a personal digital assistant, a cell phone, etc.) can connect to the Internet and play wagering games. Consequently, some wagering game manufacturers have created wagering games that can be processed by personal computing devices and offered via online casino websites ("online casinos"). However, online casinos face challenges and struggles. For instance, online casinos have struggled to provide the excitement and entertainment that a real-world casino environment provides. Some online casinos have struggled enforcing cross-jurisdictional restrictions and requirements. Further, some online casinos have struggled adapting the online gaming industry to a traditionally non-wagering game business environment. As a result, wagering game manufacturers, casino operators, and online game providers are constantly in need of innovative concepts that can make the online gaming industry appealing and profitable.

SUMMARY

In some embodiments, a computer-implemented method comprises receiving login information, by a first user input via a game controller, wherein the game controller is connected to a local area network at a geographic location outside a casino; logging in a wagering game player account using the login information, wherein the wagering game player account is for an online wagering game website; detecting a request from the wagering game player account, by a second user input via the game controller, to initiate a group wagering game; providing group wagering game content to the game controller in response to the request to initiate the group wagering game, wherein the game controller presents the group wagering game content at the geographic location for a group wagering game; detecting wagering inputs performed at the geographic location for the group wagering game via a plurality of client devices, wherein the plurality of client devices are also connected to the local area network; transacting wagers related to the wagering inputs; providing a portion of money from the wagers to the wagering game player account; and providing wagering game outcomes to the game controller, wherein the game controller provides the wagering game outcomes to the plurality of client devices.

In some embodiments, the computer-implemented method further comprises assigning a sub-account of the wagering game player account to one of the plurality of client devices; receiving a player input, via the one of the plurality of client devices; transferring funds from a personal financial account to the sub-account of the wagering game player account in response to the receiving the player input; transacting one of the wagers using the sub-account in response to one of the wagering inputs performed at the one of the plurality of client devices; and transferring a portion of the one of the wagers from the sub-account to the wagering game player account.

In some embodiments, the computer-implemented method further comprises determining a revenue sharing percentage from a revenue sharing agreement between the wagering game player account and the online wagering game website; and splitting a money amount from the wagers between the wagering game player account and the online wagering game website according to the revenue sharing percentage.

In some embodiments, the computer-implemented method further comprises detecting access to the local area network by a personal mobile device; determining identifying information for the personal mobile device; determining from the identifying information an additional wagering game player account associated with the identifying information; and using the additional wagering game player account to perform additional wagers via player input from the personal mobile device.

In some embodiments, the computer-implemented method further comprises holding a portion of money from the wagers for a progressive jackpot; and making only a plurality of players at the geographic location eligible to win the progressive jackpot.

In some embodiments, one or more machine-readable storage media having instructions stored thereon, which when executed by a set of one or more processors causes the set of one or more processors to perform operations comprising: receiving a user request, from a first user input at a game controller, to initiate a wagering game, wherein the first user input is associated with a wagering game player account for an online wagering game website, and wherein the game controller is connected to a local area network at a geographic location outside a casino; sending the user request to a wagering game server that hosts the wagering game website; receiving wagering game content from the wagering game server in response to the sending the user request; presenting the wagering game content on one or more displays at the geographic location; detecting side-wagering requests from a plurality of player inputs at the geographic location on potential outcomes for the wagering game content, wherein the plurality of players inputs are performed by a plurality of client devices to perform the side-wagering requests, and wherein the plurality of client devices are connected to the game controller via the local area network; detecting a game play request, from a second user input at the game controller, to play the wagering game content after receiving the side-wagering requests; sending the game play request to the wagering game server; receiving a wagering game outcome for the wagering game content in response to the sending the game play request; determining that at least one of the side-wagering requests indicates one potential wagering game outcome that matches the wagering game outcome, wherein the at least one of the side-wagering requests is made by one of the plurality of player inputs; and awarding an award proportional to an amount of money for the least one of the side-wagering requests.

In some embodiments, the operations further comprise: assigning a sub-account of the wagering game player account to the one of the plurality of client devices, transacting the at least one of the side-wagering requests using the sub-account; and transferring a portion of the at least one of the side-wagering requests from the sub-account to the wagering game player account.

In some embodiments, the operations further comprise detecting wagering jurisdictional rules for the geographic location; determining a wagering type permitted by the jurisdictional rules; and causing the side-wagering requests to comply with the wagering type.

In some embodiments, the operations further comprise detecting an additional request by an additional player account from an additional geographic location outside of the local area network to participate in the side-wagering requests; and authorizing the additional player account to participate in the side-wagering requests.

In some embodiments, the operations further comprise detecting a first currency type for the at least one of the side-wagering requests of the one of the plurality of player inputs; determining a second currency type required for the side-wagering requests; and converting, without user intervention, the first currency type to the second currency type.

In some embodiments, the operations further comprise: determining branding graphics stored with the wagering game player account, wherein the branding graphics identify a business identifier associated with the geographic location; and presenting the branding graphics with the wagering game content.

In some embodiments, a system comprises: an online wagering game server configured to provide wagering game content to a game controller in response to a user request, wherein the user request is associated with a wagering game player account for an online wagering game website hosted by the online wagering game server, and provide a wagering game outcome to the game controller for the wagering game content; the game controller, wherein the game controller is connected to a local area network at a geographic location outside a casino, and wherein the game controller is configured to receive the wagering game content from the online wagering game server, present the wagering game content at the geographic location, detect a plurality of side-wager requests made on the wagering game content made at the geographic location, present the wagering game outcome at the geographic location after detecting the plurality of side-wager requests, and provide a portion of money associated with the plurality of side-wager requests to the wagering game player account; and a plurality of client devices also connected to the local area network, wherein the plurality of client devices are configured to connect to the game controller via the local area network, and provide the plurality of side-wager requests to the game controller at the geographic location.

In some embodiments, the online wagering game server is further configured to detect a disconnection of one of the plurality of clients from the local area network, detect a connection of the one of the plurality of clients to the online wagering game server outside of the local area network, present the wagering game content to the one of the plurality of clients, and disable wagering capabilities on the one of the plurality of clients for the wagering game content.

In some embodiments, the local area network has sections, wherein each of the sections has some of the plurality of client devices, and wherein the game controller is further configured to detect a triggering event that occurs at the geographic location, select one of the sections in response to the detection of the triggering event, and enable wagering on only the some of the plurality of client devices in response to the selection of the one of the sections.

In some embodiments, the plurality of client devices are player stations at an electronic gaming table.

In some embodiments, the game controller is further configured to detect a triggering event that occurs at the geographic location, and provide an additional wagering game to only at the geographic location in response to the triggering event.

In some embodiments, the game controller is further configured to present a notification of the triggering event via the plurality of client devices, and include wagering controls in the notification to make wagers on the additional wagering game.

In some embodiments, the online wagering game server is further configured to provide the wagering game content to an additional game controller connected to an additional local area network at an additional geographic location, wherein the additional game controller is configured to receive an additional plurality of side-wager requests on the wagering game content, and control a competition via the wagering game content between a first entity associated with the geographic location and a second entity at the additional geographic location.

In some embodiments, an apparatus comprises: a group gaming module configured to detect a request from a user account to initiate a wagering game, wherein the user account is for an online wagering game website; provide wagering game content to a game controller connected to a local area network at a geographic location outside a casino, wherein the game controller presents the wagering game content at the geographic location to group members for the wagering game content, assign sub-accounts of the user account to the group members, track wagering requests performed by the group members at the geographic location on the wagering game content using the sub-accounts, wherein the group members use a plurality of client devices to perform the wagering requests and wherein the plurality of client devices are also connected to the local area network, assign portions of wagers from the wagering requests to the wagering game player account using the sub-accounts, and provide one or more wagering game outcomes to the game controller for the wagering game content, wherein the game controller provides the wagering game outcomes to the group members at the geographic location.

In some embodiments, the group gaming module is further configured to provide a wagering game webpage that includes the wagering game content, provide an account control interface on the webpage to control assignment of the sub-accounts, and present wagering information, regarding the wagering associated with the sub-accounts, on the account control interface.

In some embodiments, the group gaming module is further configured to detect a request from an additional wagering game player account to perform wagering at the geographic location on the wagering game content, assign one of the sub-accounts to the additional wagering game player account, transfer money from the additional wagering game player account to the one of the sub-accounts, and use the money to perform wagering from the additional wagering game player account.

In some embodiments, an apparatus comprises means for receiving a user request, from a first user input at a game controller, to initiate a wagering game, wherein the first user input is associated with a wagering game player account for an online wagering game website, and wherein the game controller is connected to a local area network at a geographic location outside a casino; means for sending the user request to a wagering game server that hosts the wagering game website; means for receiving wagering game content from the wagering game server in response to the user request; means for presenting the wagering game content on one or more displays at the geographic location; means for detecting connections, via the local area network, of a plurality of client devices to the game controller; means for detecting wagering requests via the plurality of client devices at the geographic location on potential outcomes for the wagering game content; means for holding a portion of money associated with the wagering requests for a progressive jackpot; and means for making the progressive jackpot available at only the geographic location.

In some embodiments, the apparatus further comprises means for presenting a progressive game meter on a display at the geographic location, wherein the progressive game meter indicates an amount of the progressive jackpot.

In some embodiments, the apparatus further comprises means for determining that the progressive jackpot does not pay out during a first scheduled event at the geographic location; and means for sending notifications to a plurality of player contacts of a second scheduled event at the geographic location for which the progressive jackpot will be available.

In some embodiments, the apparatus further comprises means for presenting one or more wagering game bots on a display at the geographic location, wherein the one or more wagering game bots represent one or more players accounts as being eligible to win the progressive jackpot.

BRIEF DESCRIPTION OF THE DRAWING(S)

Embodiments are illustrated in the Figures of the accompanying drawings in which.

DESCRIPTION OF ILLUSTRATIVE EMBODIMENTS

This description of the embodiments is divided into five sections. The first section provides an introduction to embodiments. The second section describes example operating environments while the third section describes example operations performed by some embodiments. The fourth section describes additional example operating environments while the fifth section presents some general comments.

Introduction

This section provides an introduction to some embodiments.

Internet users are enjoying a proliferation of social networking mechanisms (e.g., social networking websites, online chats, blogging, social networking applications, etc.) that are appearing online in vast quantities. Many of those Internet users are also wagering game players ("players"), or in other words, are users that like to play wagering games. As stated previously, some wagering game providers have been successful providing wagering games to individual players via wagering game websites, which the individual players can access via personal computers. Some of those wagering game websites provide social networking features, which provide a sense of socialization to the player while the player plays individually. However, wagering game providers have yet to find ways to provide wagering games to groups of individuals at a social gathering (e.g., a party, a wedding reception, a charity auction, etc), where the individuals do not have access to their personal home computers.

Figure 1:
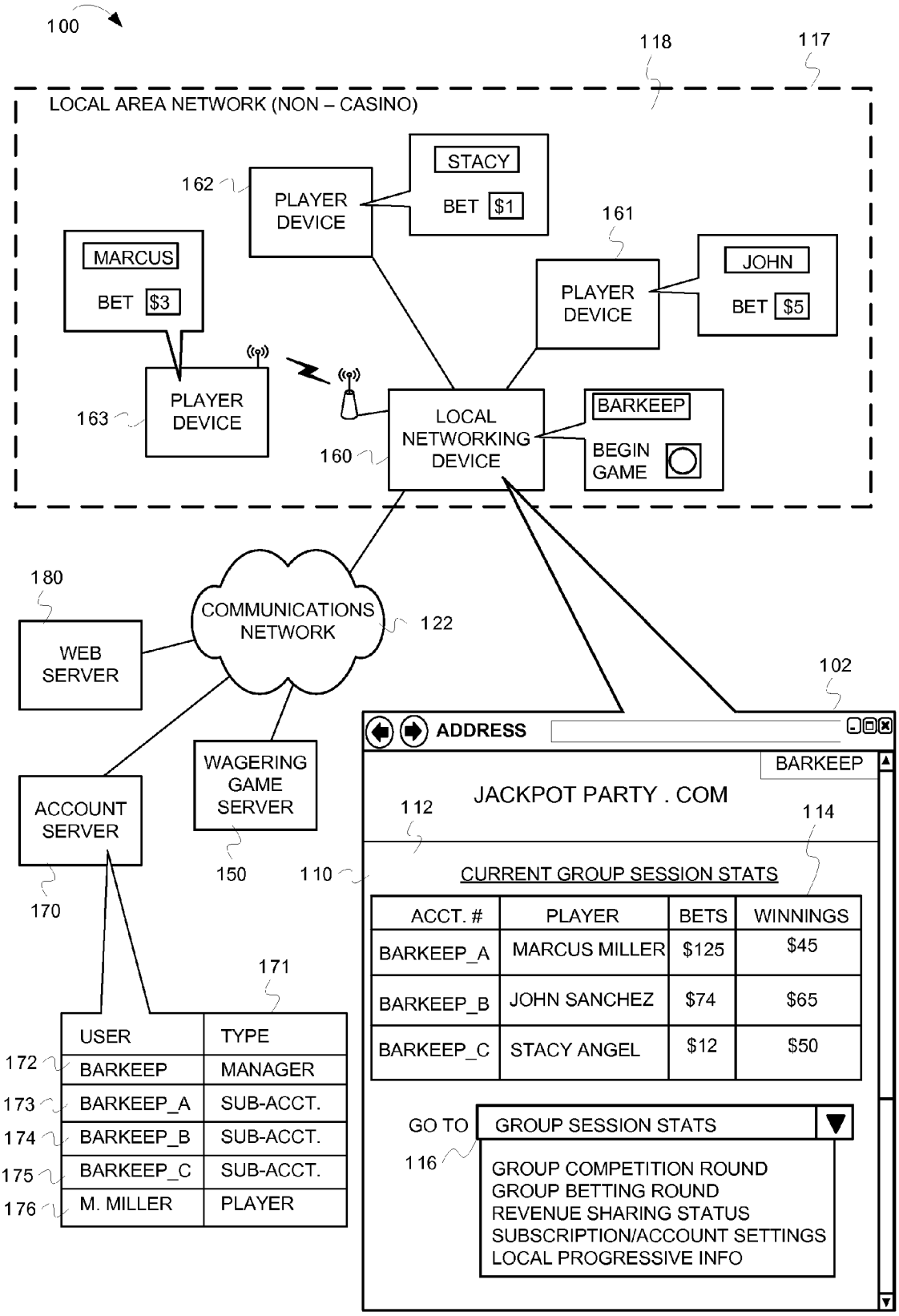
FIG. 1 is an illustration of presenting and controlling an online wagering game in a group setting, according to some embodiments.

FIG. 1 is a conceptual diagram that illustrates an example of presenting and controlling an online wagering game in a group setting, according to some embodiments. In FIG. 1, a wagering game system ("system") 100 includes a local networking device 160 connected to a wagering game server 150 via a communications network 122 (e.g. a wide area network or WAN, the Internet, etc.). Also included in the system 100 are an account server 170 and a web server 180, which are also connected to the communications network 122. The account server 170 stores wagering game player accounts ("player accounts") 172, 173, 174, 175, and 176. One of the player accounts, player account 172, can be associated with a host for a social gathering. At the social gathering, the host may desire to incorporate wagering games into the social gathering at a geographic location ("location") 118. The location 118 may be a bar, a concert hall, a sporting arena, an auction center, etc., at which wagering games are not the primary reason or source of interaction or entertainment. Nevertheless, the host can use the system 100 to offer wagering games to liven up the social gathering and generate revenue at the location 118.

The host, or host user, can log in to the player account 172 via a web browser 102, or other graphical user interface. A local networking device 160, or a display associated with the local networking device 160, can present the web browser 102. The player account 172 may be referred to herein as a host player account, or master player account. The local networking device 160 links together or controls wagering game activity from several clients 161, 162, 163 on a non-casino local area network (non-casino LAN 117). For example, the non-casino LAN 117 can be a Wi-Fi network within a location 118 for a non-casino entity (e.g., a business establishment such as a bar, a hotel, a stadium, a bingo hall, etc.). The non-casino entity may sponsor events (e.g., game night at the bar, a charity event, a sporting event, a bingo night, etc.) at the location 118. During the event the non-casino entity may desire to introduce gambling activity. However, the non-casino entity is not a casino, and may be situated in a jurisdiction that limits gambling activity. The non-casino entity, therefore, can use the system 100 to connect to an online wagering game website ("website") 110 (e.g., "Jackpot Party.com") hosted by the wagering game server 150. For instance, the non-casino entity can use the local networking device 160 to connect to the website 110. The wagering game server 150 can provide wagering game content (e.g., a slot game, a group wagering game, a bonus game, etc.), to the host player account 172 associated with the non-casino entity. The host player account 172 can use the wagering game content during a wagering game session at the location 118 associated with the non-casino LAN 117. Additional players at the location 118 can use the clients 161, 162, 163 to participate in a wagering game controlled or presented by, or in association with, the local networking device 160.

In some embodiments, the non-casino entity can utilize the system 100 to provide wagering game activity within the location 118 without needing specially configured wagering game machines or wagering game servers within the non-casino LAN 117. For instance, the clients 161, 162, 163 may be terminals or personal computers that present the wagering game content using web-browsers. In other embodiments, the clients 161, 162, 163 may have some degree of specialized configurations that work in conjunction with the local networking device 160. In some embodiments, the local networking device 160 is configured with different levels of gaming functionality so that the local networking device 160 can offer local wagering game activities that may be available only to participants at the location 118. Further, in some embodiments, a non-casino entity does not need any type of gaming license because, in some embodiments, wagering money does not change hands with patrons and the patron at the location 118, but may instead occur at a server level (e.g., on the wagering game server 150).

In some embodiments, the host player account 172 uses features and services of the website 110 for presenting and/or controlling group wagering activities on the clients 161, 162, 163. For example, the website 110 can include a graphical user interface 112 that presents group statistics 114 (e.g., bets, winnings, etc.) for a wagering game session from group members that play a group wagering game via the clients 161, 162, 163. The group members do not have to have their own user accounts on the account server, but can utilize sub-accounts that belong to the host player account 172. In one example, the host player account 172 has three sub-accounts, player accounts 173, 174, and 175. Thus, in some embodiments, the player accounts 173, 174, and 175 may be referred to herein as "player sub-accounts." The host player account 172 can use the player sub-accounts 173, 174, and 175 to track wagering activity that occurs on the clients 161, 162, 163. In other words, a group member can use one of the clients 161, 162, 163 without needing a personal player account because the group member can use one of the player sub-accounts 173, 174, 175. For instance, a group member (e.g., Stacy Angel) can register at the client 162 by entering contact information, which the host player account 172 can store and use to track the group member's activity during the group wagering game session. The client 162 can be pre-configured to automatically utilize a player sub-account (e.g., player sub-account 175). The group member (e.g., Stacy Angel) does not need to see the connection to the player sub-account 175 or even know what is happening on the local networking device 160, the account server 170 or the wagering game server 150. The system 100 can automatically assign player sub-accounts in the background. The group member can use the client 162 at the location 118 to participate in a group wagering game provided by, and controlled by, the wagering game server 150 and/or the local networking device 160.

The website 110 can provide other features accessible by one or more controls on the website (e.g., via a dropdown control 116). Some of the features may include controls, menus, settings, etc. for selecting different types of wagering game content, presenting information regarding revenue sharing with the non-casino entity, registering for and monitoring subscription services, initiating local event features for gaming events (e.g., local-area-network progressives) that are only available at the location 118, etc.

In some embodiments, a group member may also have a personal wagering game player account (e.g., the user "Marcus Miller" registers at client 163 using his own player account 176). The system 100 can associate, of link, a player sub-account 173 with the player account 176 to transfer, between the player sub-account 173 and the player account 176, funds, player history, contact information, etc. during the group wagering game session.

Further, some embodiments of the inventive subject matter describe examples of controlling group wagering games in a network wagering venue (e.g., an online casino, a wagering game website, a wagering network, etc.) using a communication network, such as the communications network 122 in FIG. 1. Embodiments can be presented over any type of communications network that provides access to wagering games, such as a public network (e.g., a public wide-area-network, such as the Internet), a private network (e.g., a private local-area-network gaming network), a file sharing network, a social network, etc., or any combination of networks. Multiple users can be connected to the networks via computing devices. The multiple users can have accounts that subscribe to specific services, such as account-based wagering systems (e.g., account-based wagering game websites, account-based casino networks, etc.).

Further, in some embodiments herein a user may be referred to as a player (i.e., of wagering games), and a player may be referred to interchangeably as a player account. Account-based wagering systems utilize player accounts when transacting and performing activities, at the computer level, that are initiated by players. Therefore, a "player account" represents the player at a computerized level. The player account can perform actions via computerized instructions. For example, in some embodiments, a player account may be referred to as performing an action, controlling an item, communicating information, etc. Although a player, or person, may be activating a game control or device to perform the action, control the item, communicate the information, etc., the player account, at the computer level, can be associated with the player, and therefore any actions associated with the player can also be associated with the player account. Therefore, for brevity, to avoid having to describe the interconnection between player and player account in every instance, a "player account" may be referred to herein in either context. Further, in some embodiments herein, the word "gaming" is used interchangeably with "gambling."

Although FIG. 1 describes some embodiments, the following sections describe many other features and embodiments.

Example Operating Environments

This section describes example operating environments and networks and presents structural aspects of some embodiments. More specifically, this section includes discussion about wagering game system architectures.

Wagering Game System Architecture

Figure 2:
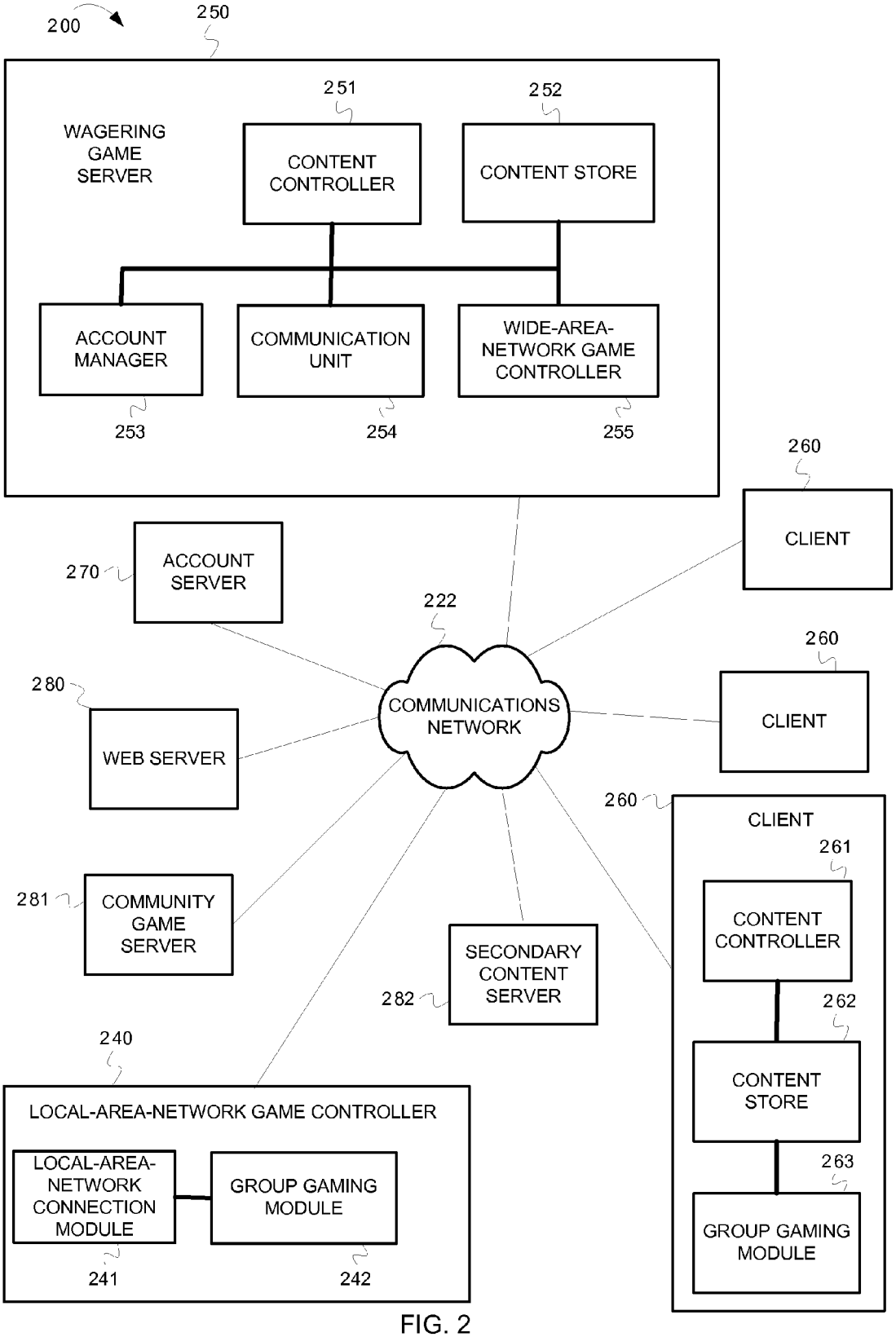
FIG. 2 is an illustration of a wagering game system architecture 200, according to some embodiments.

FIG. 2 is a conceptual diagram that illustrates an example of a wagering game system architecture 200, according to some embodiments. The wagering game system architecture 200 can include an account server 270 configured to control user related accounts accessible via wagering game networks and social networking networks. The account server 270 can store wagering game player account information, such as account settings (e.g., settings related to group games, settings related to social contacts, etc.), preferences (e.g., player preferences regarding assistance with group games, player preferences regarding group collaboration on local networks for group gaming, player preferences for secondary games on local networks, player preferences regarding award types, preferences related to virtual assets, etc.), player profile data (e.g., name, avatar, screen name, etc.), and other information for a player's account (e.g., financial information, account identification numbers, virtual assets, social contact information, etc.). The account server 270 can contain lists of social contacts referenced by a player account. The account server 270 can also provide auditing capabilities, according to regulatory rules. The account server 270 can also track performance of players, machines, and servers.

The wagering game system architecture 200 can also include a wagering game server 250 configured to control wagering game content, provide random numbers, and communicate wagering game information, account information, and other information to and from one or more clients 260. The wagering game server 250 can include a content controller 251 configured to manage and control content for the presentation of content on the clients 260. For example, the content controller 251 can generate game results (e.g., win/loss values), including win amounts, for games played on the clients 260. The content controller 251 can communicate the game results to the clients 260. The content controller 251 can also generate random numbers and provide them to the clients 260 so that the clients 260 can generate game results. The wagering game server 250 can also include a content store 252 configured to contain content to present on the clients 260. The wagering game server 250 can also include an account manager 253 configured to control information related to player accounts. For example, the account manager 253 can communicate wager amounts, game results amounts (e.g., win amounts), bonus game amounts, etc., to the account server 270. The wagering game server 250 can also include a communication unit 254 configured to communicate information to the clients 260 and to communicate with other systems, devices and networks. The wagering game server 250 can also include a wide-area-network game controller 255 configured to control wagering game activity, via a wide area network, on client devices connected to local area networks at geographic locations associated with a non-casino entity.

The wagering game system architecture 200 can also include the clients 260 configured to present wagering games and receive and transmit information to control network wagering games in group settings (e.g., at social gatherings). The clients 260 can be a computer system, a personal digital assistant (PDA), a cell phone, a laptop, a wagering game machine, or any other device or machine that is capable of processing information, instructions, or other data provided via the communications network 222. The clients 260 can include a content controller 261 configured to manage and control content and presentation of content on the clients 260. The clients 260 can also include a content store 262 configured to contain content to present on the clients 260. The clients 260 can also include a group gaming module 263 configured to control interaction with group members during a group wagering game session at a non-casino location.

The wagering game system architecture 200 can also include a local-area-network game controller 240 configured to connect clients and control wagering games in a group setting. The local-area-network game controller 240 can include a local area network connection module 241 configured to connect the clients 260 at a geographic location to a local area network. The local-area-network game controller 240 can also include a group gaming module 242 configured to control interaction with group members via the clients 260 during a group wagering game session. In some embodiments, the local-area-network game controller 240 exemplifies the local networking device 160 of FIG. 1. The local-area-network game controller 240 may also include or incorporate any of the elements of the clients 260 and may present and control wagering game content in similar ways.

The wagering game system architecture 200 can also include a web server 280 configured to control and present an online website that hosts wagering games. The web server 280 can also be configured to present multiple wagering game applications on the clients 260 and/or the local-area-network game controller 240 via a wagering game website, or other gaming-type venue accessible via the Internet. The web server 280 can host an online wagering website and/or a social networking website. The web server 280 can include other devices, servers, mechanisms, etc., that provide functionality (e.g., controls, web pages, applications, etc.) that web users can use to connect to a social networking application and/or website and utilize social networking and website features (e.g., communications mechanisms, applications, etc.). The web server 280 can also be configured to control group wagering games at non-casino locations. In some embodiments, the wagering game server 250 may include or incorporate any of the elements of the web server 280.

The wagering game system architecture 200 can also include a community game server 281 configured to provide and control content for community games, including networked games, social games, competitive games, or any other game that multiple players can participate in at the same time. In some embodiments, the wagering game server 250 may include or incorporate any of the elements of the community game server 281.

The wagering game system architecture 200 can also include a secondary content server 282 configured to provide content and control information for secondary games and other secondary content available on a wagering game network (e.g., secondary wagering game content, promotions content, advertising content, player tracking content, web content, etc.). The secondary content server 282 can provide "secondary" content, or content for "secondary" games presented on the clients 260 and/or the local-area-network game controller 240. "Secondary" in some embodiments can refer to an application's importance or priority of the data. In some embodiments, "secondary" can refer to a distinction, or separation, from a primary application (e.g., separate application files, separate content, separate states, separate functions, separate processes, separate programming sources, separate processor threads, separate data, separate control, separate domains, etc.). Nevertheless, in some embodiments, secondary content and control can be passed between applications (e.g., via application protocol interfaces), thus becoming, or falling under the control of, primary content or primary applications, and vice versa. In some embodiments, the wagering game server 250 may include or incorporate any of the elements of the secondary content server 282.

Each component shown in the wagering game system architecture 200 is shown as a separate and distinct element connected via a communications network 222. However, some functions performed by one component could be performed by other components. For example, the local-area-network game controller 240 can also be configured to perform functions of the content controller 261, the content store 262, and the group gaming module 263, and other network elements and/or system devices. Furthermore, the components shown may all be contained in one device, but some, or all, may be included in, or performed by, multiple devices, as in the configurations shown in FIG. 2 or other configurations not shown. For example, the account manager 253 and the communication unit 254 can be included in the clients 260 instead of, or in addition to, being a part of the wagering game server 250. Further, in some embodiments, the clients 260 and/or the local-area-network game controller 240 can determine wagering game outcomes, generate random numbers, etc. instead of, or in addition to, the wagering game server 250.

As mentioned previously, in some embodiments, the clients 260 can take the form of a wagering game machine. Examples of wagering game machines can include floor standing models, handheld mobile units, bar-top models, workstation-type console models, surface computing machines, etc. Further, wagering game machines can be primarily dedicated for use in conducting wagering games, or can include non-dedicated devices, such as mobile phones, personal digital assistants, personal computers, etc.

In some embodiments, clients and wagering game servers work together such that clients can be operated as thin, thick, or intermediate clients. For example, one or more elements of game play may be controlled by the client or the wagering game servers (server). Game play elements can include executable game code, lookup tables, configuration files, game outcomes, audio or visual representations of the game, game assets or the like. In a thin-client example, the wagering game server can perform functions such as determining game outcome or managing assets, while the clients can present a graphical representation of such outcome or asset modification to the user (e.g., player). In a thick-client example, the clients can determine game outcomes and communicate the outcomes to the wagering game server for recording or managing a player's account.

In some embodiments, either the client or the wagering game server(s) can provide functionality that is not directly related to game play. For example, account transactions and account rules may be managed centrally (e.g., by the wagering game server(s)) or locally (e.g., by the clients 260). Other functionality not directly related to game play may include power management, presentation of advertising, software or firmware updates, system quality or security checks, etc.

Furthermore, the wagering game system architecture 200 can be implemented as software, hardware, any combination thereof, or other forms of embodiments not listed. For example, any of the network components (e.g., the wagering game machines, servers, etc.) can include hardware and machine-readable storage media including instructions for performing the operations described herein. Machine-readable storage media includes any mechanism that stores information in a form readable by a machine (e.g., a wagering game machine, computer, etc.). For example, machine-readable storage media includes read only memory (ROM), random access memory (RAM), magnetic disk storage media, optical storage media, flash memory machines, etc. Some embodiments of the invention can also include machine-readable signal media, such as any media suitable for transmitting software over a network.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

Figure 3:
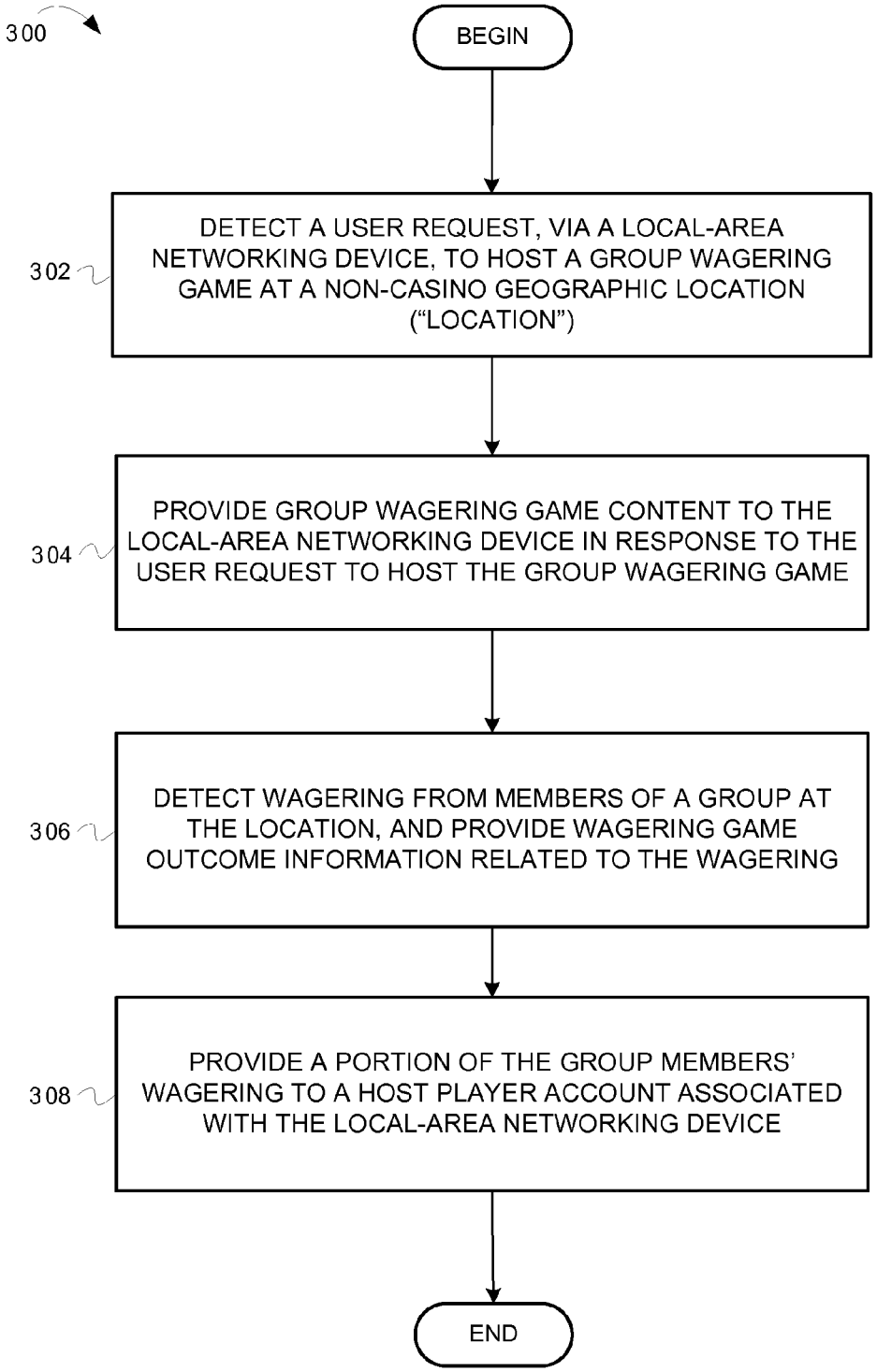
FIG. 3 is a flow diagram 300 illustrating presenting and controlling online wagering game content on a local area network at a non-casino geographic location, according to some embodiments.
Figure 4:
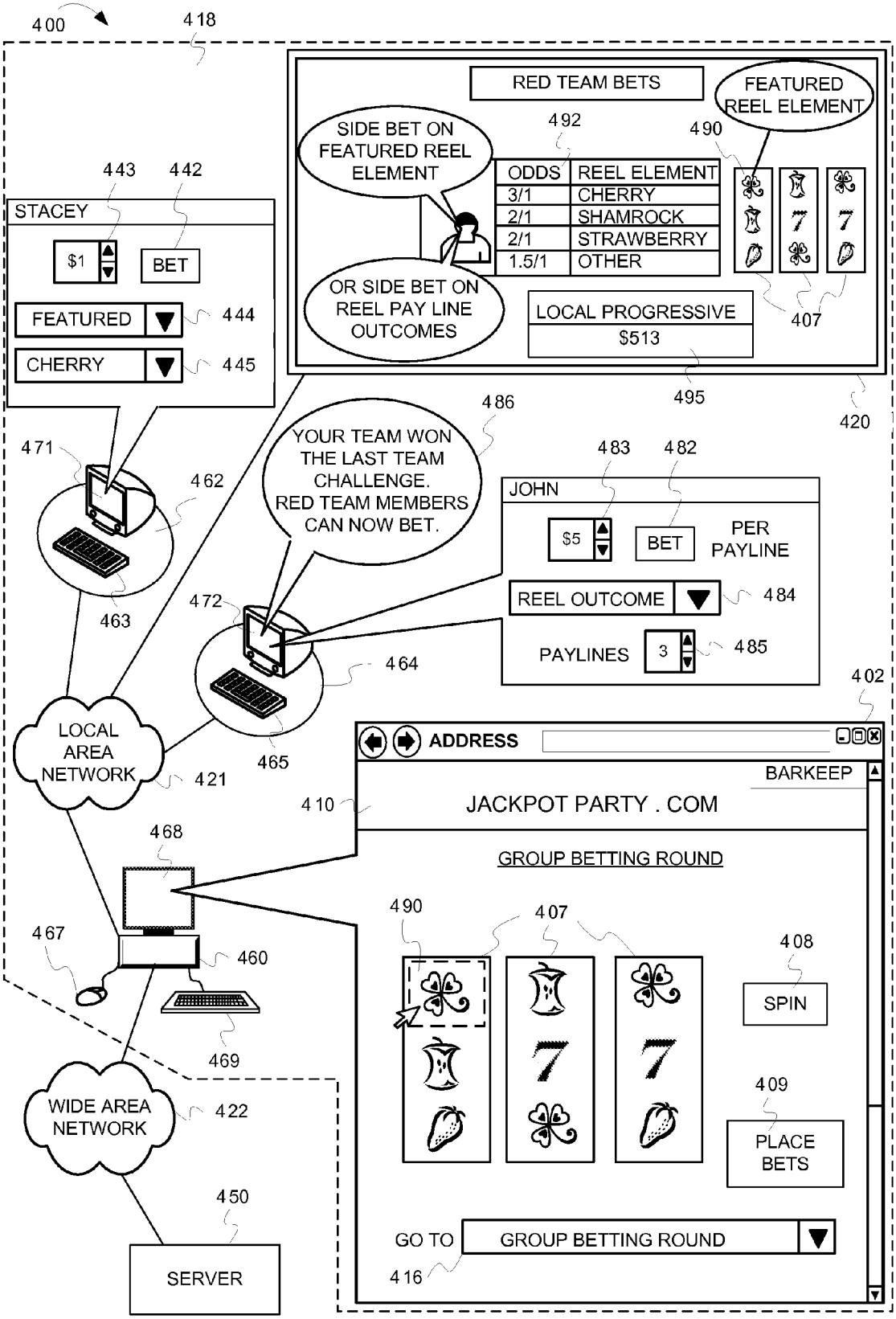
FIG. 4 is an illustration of tracking side wagers in a group wagering game for online wagering game content, according to some embodiments.
Figure 5:
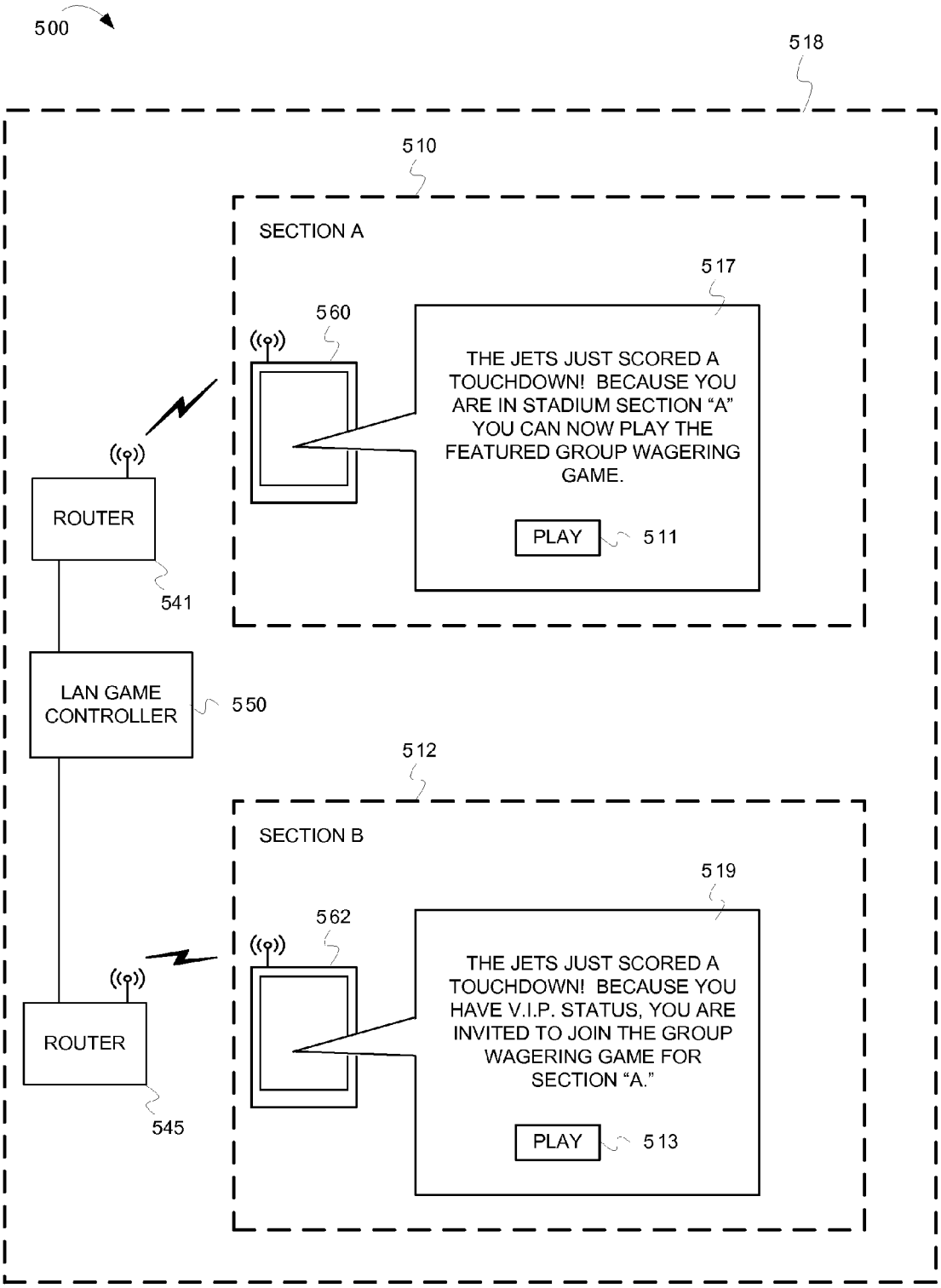
FIG. 5 is an illustration of controlling a secondary group wagering game for primary wagering game content at an electronic gaming table, according to some embodiments.

FIG. 3 is a flow diagram ("flow") 300 illustrating presenting and controlling online wagering game content on a local area network at a non-casino geographic location, according to some embodiments. FIGS. 4, and 5 are conceptual diagrams that help illustrate the flow of FIG. 3, according to some embodiments. This description will present FIG. 3 in concert with FIGS. 1, 4, and 5. In FIG. 3, the flow 300 begins at processing block 302, where a wagering game system ("system") detects a user request, or input, via a local-area networking device, to host a group wagering game at a non-casino geographic location ("location"). In some embodiments, a server detects the user request by receiving user login information, via user input at a local-area networking device for a host wagering game player account ("host player account"). In some embodiments, the local-area networking device is connected to a local area network at a geographic location outside a casino. The server logs in the host player account to a wagering game service provided by the server, or other wagering game controller (e.g., wagering game server for online game website, a master LAN controller at a stadium, etc.). The local-area networking device is configured to access the server, or other wagering game controller, via a wide area communication network. In some embodiments, the local-area networking device provides access to a local area network at a non-casino geographic location, but does not perform game control functions or activities (e.g., does not generate game control instructions, does not perform local random number generation, etc.). For example, if all client devices at a geographic location can communicate directly with an online server (e.g., web server, online wagering game server, etc.) and if the local event does not need to perform any local controlling, then the local-area networking device may function solely as a LAN access point that aggregates or associates the devices to the defined geographic location. The online server can store all the required security information. However, in other embodiments, the local-area networking device may be configured to perform local game control functions or activities (e.g., generate local game control instructions, perform random number generation for local games, etc.). In some embodiments, the local-area networking device may be a self-contained personal computer, or other hardware device, configured by a wagering game provider or manufacturer. For example, as shown in FIG. 4, the local-area networking device can be a computer 460.

FIG. 4 shows an example wagering game system ("system") 400. In the system 400, the computer 460 includes user-interfacing devices such as a keyboard 469, a mouse 467, and a display 468. The computer 460 is configured to access one or more client devices or stations ("clients") 464 and 462 via a local area network (LAN) 421. The clients 462, 464 also include user-interfacing devices, such as keyboards 463, 465 and displays 471, 472.

In some embodiments, the computer 460 is configured to run a wagering game service provided by a server 450. The server 450 provides wagering game content to the computer 460 via a wide area network (WAN) 422 based on user input generated by a host user at the computer 460 (e.g., via user input by a host user using the keyboard 467 or mouse 469).

The computer 460 is also connected to a large display 420. The computer 460 communicates wagering game content and control instructions to the clients 462, 464 and the large display 420 via the LAN 421. The clients 462, 464 communicate player user input (via the input devices 463, 465) to the computer 460 via the LAN 421. The computer 460 receives the user input and communicates the user input to a server 450 connected to the computer 460 via a wide area network (WAN) 422.

Returning momentarily to FIG. 3, the flow 300 continues at processing block 304, where the system provides group wagering game content to the local-area networking device in response to the user request to initiate the group wagering game. Returning to FIG. 4, the host user can login to the server 450 using the computer 460. The computer 460 can present a webpage 410 via a web browser 402 (or other graphical user interface) on the display 468. The webpage 410 is for an online wagering game venue (e.g., "Jackpot_ Party.com," an exemplary online wagering game website). The server 450 receives the host user's login information through the web browser 402, logs in the host user to a host player account, and presents the webpage 410 on the display 468. In some embodiments, the server 450 can detect settings associated with the host player account and can modify (e.g., skin, customize, etc.) the webpage 410 with branding associated with the host user or an establishment associated with the host user (e.g., a business establishment that controls the LAN 121, etc.). In some embodiments, the webpage 410 can present statistics, account data, contact information, or any other information related to the host player account, the host user, the establishment, etc. The webpage 410 can also present a control 416 to select one of a plurality of group wagering game settings and detect selection of one of the group wagering games (e.g., for example, in one embodiment, the control 416 is similar to FIG. 1's dropdown control 116, from which a host user can select the "Group Betting Round" option, which can subsequently present a view of the webpage 410 that shows reels 407, a spin control 408, and a bet placement control 409). In some embodiments, the webpage 410 may present a specific electronic game room, associated with an ongoing group game, chat session, or website-wide event. In some embodiments, the webpage 410 may be scheduled, or leased, for a specific period, date, time, etc.

In some embodiments, the system 400 can detect wagering jurisdictional rules for a geographic location ("location") 418 associated with the LAN 121. For example, the location 418 may be in a geographic region (e.g., state, country, etc.) that, according to jurisdictional rules, does not legally permit servers or onsite wagering game machines to perform some types of gambling processes. As a result, the computer 460 can determine what types of gambling processes are allowed for the jurisdiction and use the webpage 410, or other wagering game content, in a way that enables gambling only for certain types of wagers allowed by the jurisdictional rules. In some embodiments, the system 400 can determine that cash gambling is not allowed at the location 418, but that there is no restriction on non-cash gambling (e.g., gambling using airline miles, coupons, player loyalty points, etc.). As a result, the system 400 can convert, or modify, any controls, settings, wagers, etc. to function only for non-cash gambling. In some embodiments, the system 400 can detect that a jurisdiction may permit cash gambling and may enable cash gambling as well as non-cash gambling. For instance, the system 400 can provide controls for players to assign their own values to non-cash types. For example, if a player wants to gamble for airlines miles instead of cash, the player could assign a value that the player will accept for airline miles (e.g., airline miles are worth $0.25 per mile to that player) and the player will accept miles in place of money up to the value specified by the player. In some embodiments, the system 400 can enable both cash and non-cash wagers in the same play (e.g., a player can bet $1 and 25 airline miles). In some embodiments, if the jurisdiction does not allow any gambling, neither cash nor non-cash, the system 400 can still allow use of the wagering game content but can deactivate gambling functionality.

Returning now to FIG. 3, the flow 300 continues at processing block 306, where the system detects wagering from members of a group at the location, and provides wagering game outcome information related to the wagering. In some embodiments, the system can detect access from multiple stations (e.g., tables, kiosks, sections, etc.) associated with the geographic location. Each station has a device used by a separate member of the group or separate groups of members. The system can verify that the device at the station is within (e.g., connected to, within broadcast range of, etc.) the local area network using global-positioning IP detection, required Wi-Fi access/authentication, etc. In some embodiments, the system can require players at the geographic location to login to a station manager at the geographic location. For example, in FIG. 4, the system 400 can require that each client 462, 464 registers with the computer 460 before being used to participate in group gaming. The clients 462, 464 can be pre-configured to access the computer 460 so that a player, or group member, needs only power up the clients 462, 464 or perform a basic login procedure.

In some embodiments, the system 400 can assign each client 462, 464 to a sub-account of the host's player account. FIG. 1 described previously an example wherein players logged in to the player devices 161, 162, 163 and used sub-accounts of the "Barkeep" user account 172. The system 100 tracked individual wagering activity for the group members using the player devices 161, 162, 163 using the sub-accounts.

In some embodiments, the system 400 can connect to personal mobile devices (e.g., smart phones, personal digital assistants, laptops, etc.) that can connect to the LAN 121 using Wi-Fi, or that can connect directly to the server 450. The system 400 can detect whether the personal mobile device is within range of the LAN 121 and enable access to a group game played at the location 418. In some embodiments, the computer 460 and/or the server 450 can communicate with the personal mobile devices in different ways. For example, some personal mobile devices have browser applications and TCP/IP addressing capabilities. A player can log on to a website using a browser application on the personal mobile device. The computer 460 can force the browser application to load a portal page associated with the location 418. Other personal mobile devices, however, may not have browser capabilities. The system 400, however, can still communicate wagering or other game functionality using text messaging, chat, or other communication means. In some embodiments, when the personal mobile device leaves the location 118 (e.g., disconnects from the LAN 121, leaves the broadcast range of the LAN 121, leaves the establishment at the location 118, etc.), the system 400 can continue presentation of group play on the personal mobile device using a long-range mobile wireless network (e.g., a telephone network, a satellite broadcast, etc.). The system 400 can continue presentation of the group play and, depending on the jurisdiction for the location 118, continue to allow wagering or to disable wagering. The system 400 may, however, continue to track play by the owner of the personal mobile device even if the owner is not wagering. In some embodiments, the system 400 can cut the player over to an online version of the group wagering game, as an online player, so that the player can use wagering functionality for a web interface associated with the online version, and not use a portal, or other user interface, associated with the location 118. If the player leaves the location 118, the system 400 can make the player ineligible for local gaming events, like local progressives, held exclusively at the location 118, unless the player pays a fee or has rights to have an agent or proxy continue playing on their behalf at the location 118. One example of an agent or proxy may be another group member that is authorized to play on the player's behalf. Another example of a player or agent is a bot, or automated representative for the player (e.g., like a fish in a fish tank game) that stays at the location and may win for a long-standing local game (e.g., if no one wins a progressive during a group game at the location 118, all the players' avatars can enter a fish tank for a continued chance to win the progressive).

The clients 462, 464 can receive wagering game content from the computer 460 and the clients 462, 464 can present the wagering game content on the displays 471, and 472. Group members can perform individual wagering activity (e.g., perform player inputs that place bets or wagers) for the group wagering game using the input devices 463, 465. The clients 462, 464 can submit the player input to the computer 460, which, in some embodiments, can submit the player input to the server 450. The server can respond to the player input with wagering game control information, updated wagering game content, etc. The clients 462, 464 can belong to different teams, or sub-groups, which can compete in the group wagering game. For example, a player "Stacey" can be on a first team (e.g., the "Red" Team) and another player "John" can be on a second team (e.g., the "Blue" Team). In some embodiments, the individual team members of each team can perform individual bets, or wagers, each of which can receive a random wagering game outcome (i.e., provided by the server 450). However, the random win/loss results for each individual team member can contribute to overall group scores, and thus the groups, or teams, can still compete.

In some embodiments, the system 400 presents a group wagering game whose outcomes are associated with a separate, or independent, wagering game application (e.g., a slot game) or separate event (e.g., a horse race, a sporting event, etc.) that provides potential outcomes that the group members can bet on during the group wagering game. For example, the system 400 can provide a primary wagering game (e.g., a slot game associated with the webpage 410), and a secondary group wagering game which depends on the outcome of the primary wagering game (e.g., a side-betting game for group members to bet on the slot game associated with the webpage 410). For instance, in FIG. 4, the computer 460 presents a slot game on the large display 420. The large display 420 can present the reels 407 of the slot game along with an odds chart 492 that are used for a group wagering game. Each of the clients 462, 464 can present wagering controls (e.g., bet meters 443, 483, and betting buttons 442, 482) on the displays 471, 472 that can be associated with the group game and/or the slot game. The group members can use the wagering controls to make wagers on what the reels 407 will present when spun. The computer 460 and/or the server 450 can present the odds chart 492 on what will appear on the reels 407. For example, the server 450 can present the webpage 410, and the host player can spin the reels 407 using the spin button 408. The server 450 can then generate, via random results, the outcome of the reels 407. However, in some embodiments, the computer 460 and/or server 450 receives side-bets, based on side-bet odds, from the group members using the clients 462, 464. The group members make the side-bets on what the group members believe one or more of the reel elements may be, after the host player account spins the reels 407. For example, a first group member (e.g., the "Stacey" user at the client 462), bets $1 and indicates, via a first wager selector dropdown 444, that the $1 bet should be directed toward a featured reel element 490. The first group member, Stacey, also indicates, via a reel-element selector dropdown 445, a graphical image that Stacey believes the featured reel element 490 will be after the host user spins the reels 407. For instance, Stacey selects on the reel-element selector dropdown 445 that the featured reel element 490 will be an image of a cherry. The system 400 indicates on the large display 420 odds on the cherry element (e.g., three-to-one odds that the featured reel element will be a cherry). On the other hand, a second group member (e.g., the "John" user at the client 464), bets $5 and indicates, via a second wager selector dropdown 484, that the $5 bet should be directed toward the reel outcome of the reels 407. The second group member, John, further indicates, via a payline selection control 485, a number of pay lines that John wants to bet on the potential outcome of the reels 407 after the host user spins the reels 407. Stacey and John, therefore, bet on different potential configurations of the reels 407, but the different potential configurations are dependent on a single spin of the reels 407 made by the host user.

The system 400 can determine wins and losses for the group members' wagering. For example, the system 400 can determine wins by determining that the outcome of the spin equates to one or more potential outcomes configurations indicated, and wagered on, by the group members. The system 400 can determine payout amounts associated with the one or more wins based on odds of occurrence for the potential outcome configurations when the one or more wagers were received. The system 400 can then payout the payout amounts to the group members who won.

In some embodiments, the system 400 can provide an additional secondary game that incorporates the group members' teams (e.g., a team competition game), where the aforementioned Red team and Blue team can win awards or prizes for participating in the side-betting secondary game. The system 400 tracks winnings from bets for different team members during the team competition game. For example, Stacey, John, and an additional user (e.g., Marcus, the online group member) are all on the Red team. The system 400 can track winnings from Stacey's, John's and Marcus' bets made during the group game session conducted by the host user. The system 400 can impose a time limit, or series of time limits, during which the group competition game lasts. At the end of the time limit, the group whose members have won the most wins the team competition game. The system 400 can restrict betting by group members per team based on events that occur at the location. For example, the system 400 can condition the opportunities to bet on performance in challenges from a non-wagering game, such as correctly answering questions in a trivia game, earning the most points in a battle game, or performance in any other game of knowledge or skill. In other words, the system 400 can present a non-wagering game challenge to the group members, such as presenting a trivia question on the large display 420. The group members can use the clients 462, 464 to quickly answer the trivia question. Whichever team has the most correct answers, or whichever team answers quickest may earn an opportunity to bet during a betting round, as indicated by the message 486 which indicates that the Red team won the last non-wagering game challenge and can now bet during the side-betting game.

The system 400 can provide the side-betting game, the team competition game and other secondary games and events, such as local tournaments, local community bonus games, local progressives, etc., which can be available only to participants at, or associated with, the location 418. The secondary games and events localized to the location 418 may be referred to herein as localized events. One example of a localized event is a local progressive. The system 400 can capture a portion of wagering funds that the host player account keeps as profit from individual wagering activity of the group members. The system 400 can use the captured portion of the funds to fund a local-area-network progressive jackpot that only group members at location 118 are eligible to win. In some embodiments, a sponsor can match the captured portions of the funds for the local progressive jackpot. The sponsor can be, for example, the host player account, a business establishment associated with the host player account or location 118, an online gaming venue associated with the server 450, a corporate sponsor of an event at the location 118, etc. The system 400 can track the amount of the progressive jackpot using a local progressive counter 495. The system 400 can determine, by random selection, one of the group members or a player account (e.g., a player sub-account) associated with one of the group members, to win the local progressive jackpot. The computer 460 or the server 450 can provide the random selection for the local progressive jackpot. The system 400 can then transfer the jackpot amount, associated with the local-area-network progressive jackpot, to the group member, (i.e., transfer the jackpot amount to the player account associated with the group member). The system 400 can impose a time limit on the local progressive so that the local progressive occurs within a specific time period. In some embodiments, if the local progressive does not "hit" or award a jackpot during a specific localized event or time period, the system 400 can hold over the progressive amount until the next localized event.

In some embodiments, the system 400 can use triggers to initiate a gaming outcome for the localized events. In some embodiments, the system 400 can initiate triggers for a gaming outcome based on activities that occur at the location or during a localized event. In some embodiments, a trigger can come from group cooperation or collaboration (e.g., a group member answers a trivia question correctly, a group member gets a high score, a team gets a high score, a section of the geographic location makes more noise, etc.). In some embodiments, the trigger can come from a host user, (e.g., a host pushes a button). In some embodiments, the trigger can come from primary or secondary wagering game content (e.g., a reel combination or event in a wagering game). In some embodiments, the trigger can come from a sporting event that occurs at the location 418 (e.g., a sports team scores a goal, a horse wins, places, or shows, etc.)

In some embodiments, the system 400 can present player images (e.g., avatars, video images, etc.) on the large display 420 of individual group members who are at the clients 462, 464. The system 400 can also present player images of other individuals who may be connected to the group games for the location 118 but that may be connected online or via personal mobile devices instead of at the clients 462, 464. The system 400 can also present the player images on the individual displays 471, 472 at each client 462, 464. If a group member accesses the system 400 as a player that is not at the location 418, the system 400 can present a player image of the group member on the large display 420 so that others at the location can see the group member even though the group member may not physically be at the location 418. The system 400 can present online players different from on-site players (e.g., online players are presented as avatars while on-site players are presented as photographs or videos). Online players are players that request to access the event at the location 418 via the Internet. The host user authorizes the online players to join, although the system 400 may impose restrictions on online players that are not imposed on the on-site players.

In some embodiments, the system 400 provides a group wagering game only to participants at, or associated with, the location 418. In some embodiments, however, the system 400 can provide competition with a second location (e.g., link an event or group game at the location 418 with another non-casino location). The two locations can compete in the group game (e.g. one location against another location). The second location can also have a local-area networking device and an additional host user's player account controlling gaming activity at the second location. The group members at each location can compete against each other. The large display 420 can present statistics of the competitive wagering game activity.

In some embodiments, the system 400 can add geographic location services and/or products features (e.g., add drinks buttons to a client display, incorporate geographic location services into wagering game content, etc.). In some embodiments, the system 400 can provide specific services that assist the group members and that are specific to the location 418. For example, the system 400 can provide automatic currency conversion or dynamic switching of currencies. The system 400 can detect at least one wager made by the group members on at least one of the clients 462, 464, determine that the wager is a first currency type, determine a second currency type required for the group wagering game, and convert the at least one wager from the first currency type to the second currency type.

In some embodiments, the system 400 can schedule localized events and can notify group members of an upcoming scheduled event. The system 400 can detect that a player account for one of the group members accesses the server 450 away from the location 418. For instance the player account may access from home (e.g., via a home computer) an online wagering website hosted by the server 450 to play wagering games. The system 400 can determine the geographic location for the player (e.g., determine geographic location of a home computer using an IP address). The system 400 can search a group wagering game event calendar and find one or more scheduled group wagering game events scheduled by the host player account, or other host player accounts, that host scheduled group wagering game events. The host player accounts can be associated with one or more non-casino establishments that are in geographic proximity to (e.g., within a 10 mile radius of) the geographic location for the player device. The system 400 can determine street addresses associated with the one or more establishments and notify the player account of the times and dates of the scheduled events, as well as the street addresses for the events.

In some embodiments, the system 400 can incentivize a player account to attend a specific scheduled event. The system 400 can determine one or more incentives (e.g., better odds, more points, etc.) to present to the player account. In some embodiments, the system 400 can determine incentives based on subscription settings/incentives settings set by the player accounts. When the system 400 notifies the player of the scheduled event, the system 400 can include the incentives during the notifying (e.g., include incentives in email, text messaging, etc.). For example, the system 400 can offer sweepstakes incentives (e.g., ball drop balls, game bonus/multiplier elements) that will be at a nearest participating geographic location.

In some embodiments, the system 400 can provide specific awards that are unique to the location 418. For example, the system 400 can provide rights to have another player (e.g., a celebrity) sit at a station (e.g., at the clients 462, 464, at poker tables for a poker tournament, at dinner tables for a charity event, etc.).

The system 400 can also transfer items between different player accounts. For example, the system 400 can transfer money from a personal online financial account for a player (e.g., an online wagering game website financial account, a social networking financial account, a massively multiplayer online game financial account, a banking account, etc.) to a session balance for the location 418. The system 400 can connect to the online financial account for a group member and transfer funds from the online financial account to a session account controlled/linked to the host player account. The host player account holds the group members transferred funds temporarily until the gaming session ends. The group members make wagers for the individual wagering activity, during the session, using the money held in the session account. In some embodiments, the system 400 can transfer funds to an account associated with a charity. In some embodiments, the system can also transfer game or player awards (e.g., trophies, progress points, loyalty points, multipliers, free spins, credits, etc.) won at the location 418 to individual player accounts so that the players can use the awards when at a land-based casino, on online casino.

Returning again to FIG. 3, the flow 300 continues at processing block 308, where the system provides a portion of the group members' wagering to a host player account associated with the local-area networking device. For example, as described above in FIG. 1, the system 100 allocates a portion of wagers to the host player account 172 using the player sub-accounts 173, 174, and 1276. In another example, such as in FIG. 4, the computer 460 can track side-bets locally and locally allocate portions of wagering from group members to the host player account associated with the computer 460. The server 450 can assist with tracking the side-bets and with financially tracking and/or controlling the side-bets in conjunction with the host player account. In some embodiments, the system 400 can track profits on the side-bets and allocate a profit split between the host player account (i.e., with the establishment at the location 418) and the wagering game provider or online source of wagering game content (i.e., with the "Jackpot_Party.com" website) associated with the server 450. The system 400 can refer to profit sharing agreements made between the wagering game provider and the host player account to determine the profit split percentages. The system 400 can also utilize statistics such as number of group members in attendance, number of advertisements shown, amount of betting, etc. to determine the profit sharing percentages.

Returning to FIG. 3, in some embodiments, the system can include a master LAN controller that controls wagering game activity for multiple sections of a LAN at a geographic location. The sections are areas (e.g., divisions, sub-areas, mini-LANs, hotspots, etc.) of the geographic location in which attendees of a performance or event at the geographic location are eligible to wager on an event or play a wagering game. In one example, the master LAN controller can detect an upcoming event that occurs during a sports performance, or other similar type of performance, within the geographic location. The upcoming event can be a play or series of plays in a sporting event. For example, the master LAN controller can determine an upcoming play or series of scheduled plays during which an athlete or group of athletes may successfully perform (e.g., may successfully win a subsequent tennis set, may successfully score on a subsequent football drive, etc.). The system can determine at least one section that can wager on the upcoming play or series of scheduled plays. The master LAN controller can select one section of the location and notify eligible attendees in the section (e.g., attendees with wagering game player accounts) in the section of an opportunity to wager on the upcoming play or series of scheduled plays. The system can notify the eligible attendees using cell phone text messages, using a billboard in the section, or in other ways. The system can detect wagering activity from devices that are within a boundary of the section. The eligible attendees use the devices to wager on the upcoming play or series of scheduled plays. The eligible attendees can make wagers, via text messaging, via wireless communication, etc. The eligible attendees can connect to the devices to Wi-Fi hotspots at the location and can connect to a local wagering portal (e.g., the master LAN controller can force a portal webpage when an eligible attendee connects their cell phone to the Wi-Fi network and/or logs on to a cell phone browser application). The system can take wagers on the upcoming play or series of scheduled plays and determine an outcome of the upcoming play or series of scheduled plays as they occur. The system can pay out winners based on the results of the upcoming play or series of scheduled plays.

In some embodiments, the master LAN controller can provide a wagering game in one of the sections based on an event that occurs within the location. For example, in FIG. 5, a wagering game system ("system") 500 includes a local-area-network game controller ("LAN game controller") 550 that connects to various routers 541, 545 of a location 518, such as at a sports stadium. Router 541 provides wireless access to a first section 510 (e.g., "Section A") of a wireless LAN at a geographic location ("location") 518. A first personal mobile device ("first mobile device") 560, which belongs to a first attendee at the location 518, is in the first section 510. Router 545 provides wireless access to a second section 512 (e.g., "Section B") of the wireless LAN at the location 518. A second personal mobile device ("second mobile device") 562, which belongs to a second attendee, is in the second section 112. The first and second attendees are at a sporting event (e.g., a football game) held at the location 518 (e.g., a stadium). The LAN game controller 550 determines that the attendees are eligible to play a wagering game (e.g., the LAN game controller 550 determines that both the first attendee and second attendee have wagering game player accounts). The LAN game controller 550 detects an event that occurs during the sporting event (e.g., one team scores a touchdown), and then makes the first section 110 eligible to play a wagering game because the event occurred. The LAN game controller 550 can detect that the first mobile device 560 is within a boundary the first section 110 (e.g., within a broadcast range of the router 541, within a boundary of a seating section, etc.) and sends a first message 517 to the first mobile device 560. The first message 517 indicates that the first attendee can play in a wagering game because the sports team scored a goal. The first message 517 can also include a control 511 that launches the wagering game on the first mobile device 560. The second mobile device 562, however, would not be eligible to play the wagering game because it is not in the first section 510. However, the LAN game controller 550 can determine other factors may make the second attendee eligible to play the wagering game (e.g., the second attendee has a sufficient number of loyalty points, the second attendee has a specific status, etc.). As a result, the LAN game controller 550 can send a second message 519 to the second mobile device 562. The second message 519 indicates that the second attendee is eligible to play the wagering game for the first section 510. The second message 519 also includes a control 513 that can launch the wagering game on the second mobile device 562.

Figure 6:
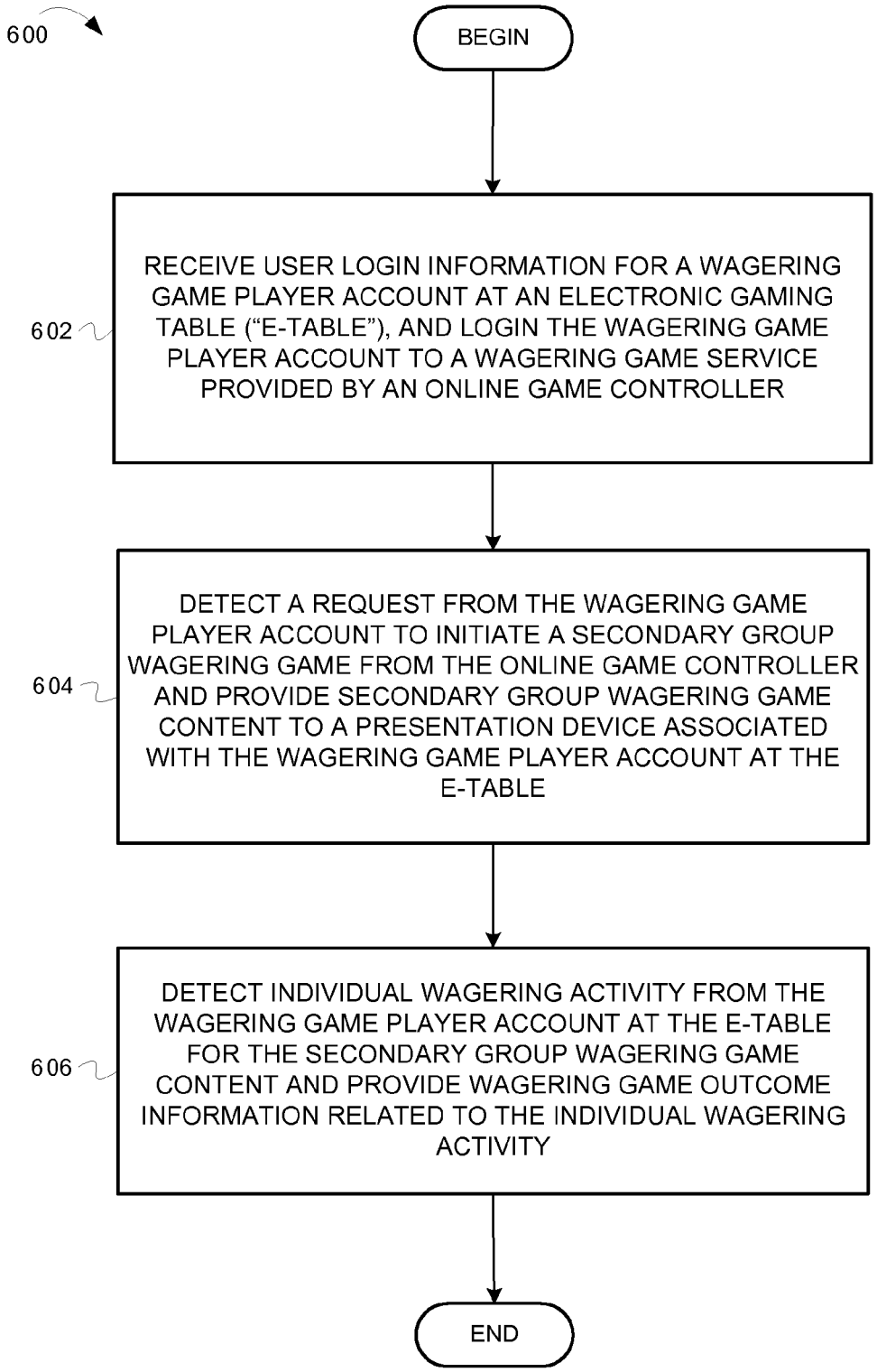
FIG. 6 is a flow diagram 600 illustrating presenting and controlling a secondary group wagering game at an electronic wagering table, according to some embodiments.

FIG. 6 is a flow diagram ("flow") 600 illustrating presenting and controlling a secondary group wagering game at an electronic wagering table, according to some embodiments. In FIG. 6, the flow 600 begins at processing block 602, where a wagering game system ("system") receives user login information for a wagering game player account at an electronic gaming table ("e-table"), and logs in the wagering game player account to a wagering game service provided by an online game controller. In some embodiments, the system can incorporate a secondary group wagering game into a primary wagering game at a casino. The primary game can be a type of wagering game, such as poker or blackjack, during which multiple people can play together, simultaneously. The system can present the primary game at an electronic wagering game table ("e-table"). The system can link together multiple geographic locations and diverse wagering venues (e.g., other casinos, online wagering venues, non-casino business establishments, etc.) so that the player(s) at the e-table can participate in a secondary group wagering game while playing the primary wagering game. The system can incorporate the secondary group wagering game as a side-betting game similar to examples described in FIGS. 3 and 4. The system can utilize an online game controller to control the secondary group wagering game.

In some embodiments, the online game controller can be a web server that hosts an online wagering game website. The e-table can access the online wagering game website via a wide area communication network, such as the Internet. A player at the e-table can login to a player account at the e-table using a player card swiped at a player station console or swiped by a dealer at the e-table. The e-table can use login information from the player account to access an online gaming account for the player that the online wagering game website can use to track the player's activity during the secondary group wagering game. A local server at the casino can connect to a web server for the online wagering game website and can communicate login information to the web server. In some embodiments, a dealer at the e-table can control player logins and/or control access to the secondary group wagering game content.

The flow 600 continues at processing block 604, where the system detects a request from the wagering game player account to initiate a secondary group wagering game from the online game controller and provides secondary group wagering game content to a presentation device associated with the wagering game player account at the e-table. The system can present the secondary group wagering game content on a player station display, a display at the e-table, etc. The web server can provide the secondary group wagering game content for the secondary group wagering game to the e-table via the local server at the casino.

The flow 600 continues at processing block 606, where the system detects individual wagering activity from the wagering game player account at the e-table for the secondary group wagering game content, and provides wagering game outcome information related to the individual wagering activity. In some embodiments, the system can fund online progressive games using onsite funds. In some embodiments, the system can detect individual wagering activity for the primary game and attribute it to the secondary wagering game (e.g., take a portion of a primary wager of a primary wagering game (e.g., blackjack) at the e-table and use the portion to fund an online progressive jackpot, or use it to fund a bonus group game that the player account can play when triggered. In some embodiments, the local primary game (e.g., the blackjack or poker game) can use radio-frequency identification (RFID) chips to track how much money is going across the e-table and take the side game/progressive contributions out of the money used in the primary game.

In some embodiments, the system can perform a casino-wide localized event as the secondary group wagering game. The system can monitor the casino-wide localized event by presenting, on a display by each e-table, betting information that occurs at e-table for the primary wagering game (e.g., primary game history, bet information for the primary game at the e-table, minimum bet values for the primary game), as well as information for the casino-wide localized event.

The system can also present information for additional secondary games associated with the secondary group wagering game (e.g., present online progressive levels, present secondary wagering game meters, etc.). In some embodiments, the system can include players not at the establishment. For example, the system can detect a request by an additional player account from a different e-table, from an additional geographic location outside of the local area network, from an online wagering game website, or elsewhere.

Additional Example Operating Environments

This section describes example operating environments, systems and networks, and presents structural aspects of some embodiments.

Wagering Game Computer System

Figure 7:
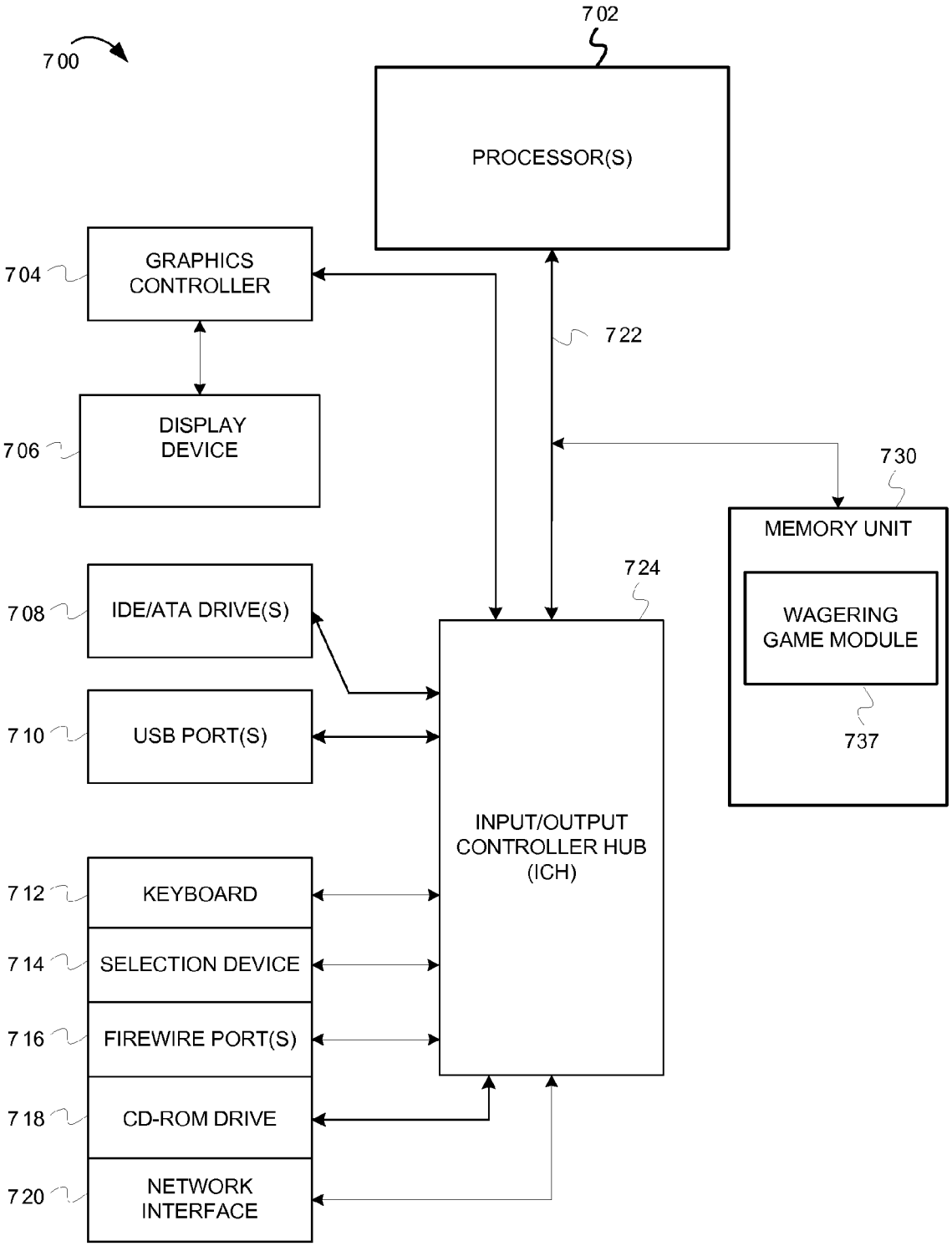
FIG. 7 is an illustration of a wagering game computer system 700, according to some embodiments.

FIG. 7 is a conceptual diagram that illustrates an example of a wagering game computer system ("computer system") 700, according to some embodiments. In FIG. 7, the computer system 700 may include a processor unit 702, a memory unit 730, a processor bus 722, and an Input/Output controller hub (ICH) 724. The processor unit 702, memory unit 730, and ICH 724 may be coupled to the processor bus 722. The processor unit 702 may comprise any suitable processor architecture. The computer system 700 may comprise one, two, three, or more processors, any of which may execute a set of instructions in accordance with some embodiments.

The memory unit 730 may also include an I/O scheduling policy unit 7 and I/O schedulers 7. The memory unit 730 can store data and/or instructions, and may comprise any suitable memory, such as a dynamic random access memory (DRAM), for example. The computer system 700 may also include one or more suitable integrated drive electronics (IDE) drive(s) 708 and/or other suitable storage devices. A graphics controller 704 controls the display of information on a display device 706, according to some embodiments.

The input/output controller hub (ICH) 724 provides an interface to I/O devices or peripheral components for the computer system 700. The ICH 724 may comprise any suitable interface controller to provide for any suitable communication link to the processor unit 702, memory unit 730 and/or to any suitable device or component in communication with the ICH 724. The ICH 724 can provide suitable arbitration and buffering for each interface.

For one embodiment, the ICH 724 provides an interface to the one or more IDE drives 708, such as a hard disk drive (HDD) or compact disc read only memory (CD ROM) drive, or to suitable universal serial bus (USB) devices through one or more USB ports 710. For one embodiment, the ICH 724 also provides an interface to a keyboard 712, selection device 714 (e.g., a mouse, trackball, touchpad, etc.), CD-ROM drive 718, and one or more suitable devices through one or more firewire ports 716. For one embodiment, the ICH 724 also provides a network interface 720 though which the computer system 700 can communicate with other computers and/or devices.

The computer system 700 may also include a machine-readable medium that stores a set of instructions (e.g., software) embodying any one, or all, of the methodologies for control group wagering games. Furthermore, software can reside, completely or at least partially, within the memory unit 730 and/or within the processor unit 702. The computer system 700 can also include a wagering game module 737. The wagering game module 737 can process communications, commands, or other information, to control group wagering games. Any component of the computer system 700 can be implemented as hardware, firmware, and/or machine-readable media including instructions for performing the operations described herein.

Personal Wagering Game System

Figure 8:
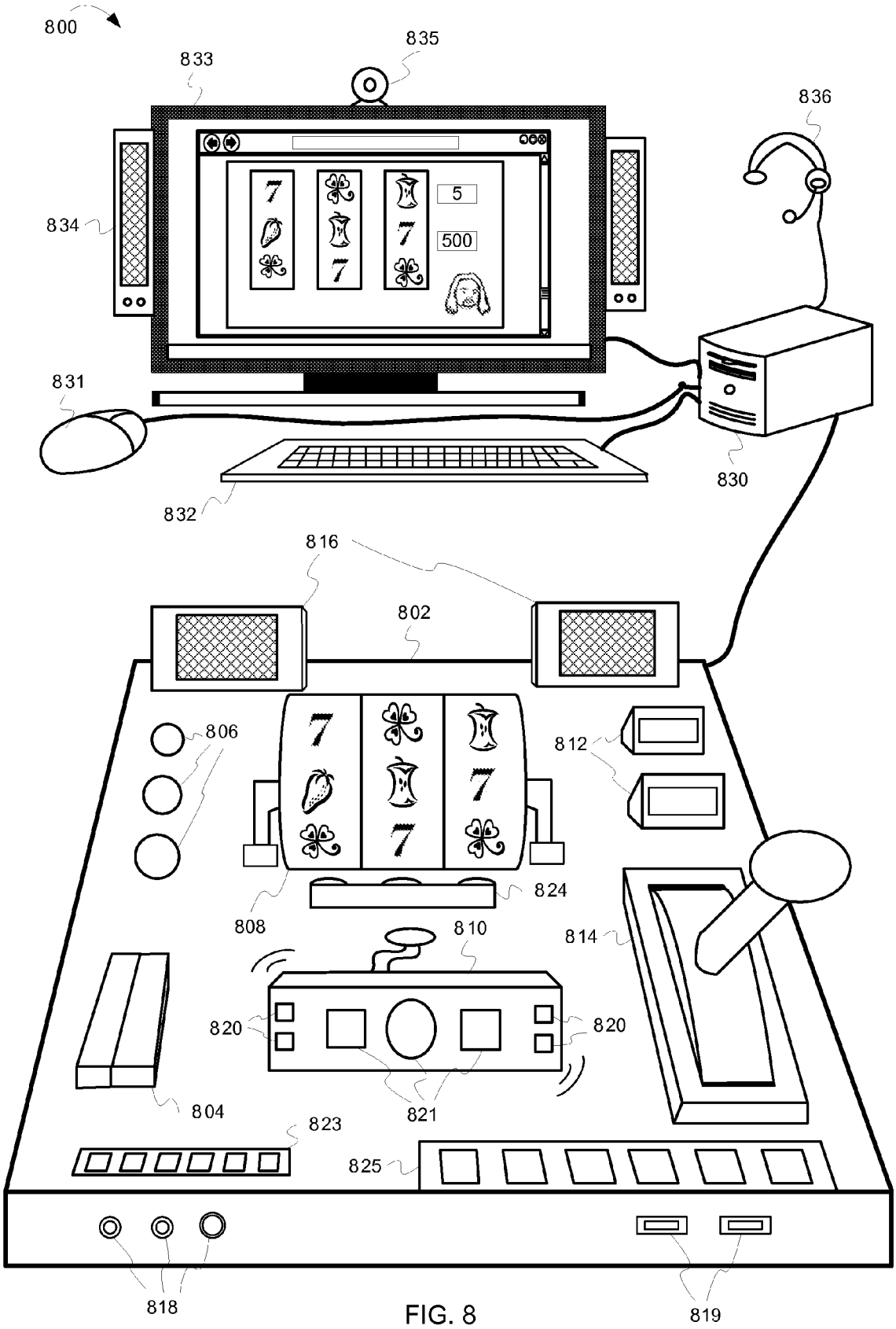
FIG. 8 is an illustration of a personal wagering game system 800, according to some embodiments.

FIG. 8 is a conceptual diagram that illustrates an example of a personal wagering game system 800, according to some embodiments. In FIG. 8, the personal wagering game system ("system") 800 includes an exemplary computer system 830 connected to several devices, including user input devices (e.g., a keyboard 832, a mouse 831), a web-cam 835, a monitor 833, speakers 834, and a headset 836 that includes a microphone and a listening device. In some embodiments, the webcam 835 can detect fine details of a person's facial features, from an eye-level perspective. The web-cam 835 can use the fine detail to determine a person's identity, their demeanor, their facial expressions, their mood, their activities, their eye focus, etc. The headset 836 can include biometric sensors configured to detect voice patterns, spoken languages, spoken commands, etc. The biometric sensors in the web-cam 835 can detect colors (e.g., skin colors, eye colors, hair colors, clothing colors, etc.) and textures (e.g., clothing material, scars, etc.). The biometric sensors in the web-cam 835 can also measure distances between facial features (e.g., distance between eyes, distance from eyes to nose, distance from nose to lips, length of lips, etc.). The system 800 can generate a facial and body map using the detected colors, textures, and facial measurements. The system 800 can use the facial and body map to generate similar facial features and body appearances for a player account avatar. Also connected to the computer system 830 is a gaming control device ("gaming pad") 802 including wagering game accoutrements associated with wagering games. The wagering game accoutrements include one or more of prop reels 808, prop game meters 812, indicators 806, a game control device 810, a physical lever 814, a magnetic card reader 804, a video projection device 824, input/output ports 818, USB ports 819, and speakers 816. The gaming pad 802 can present feedback of online activities. For instance, the gaming pad 802 can use vibrations and signals on the gaming control device (e.g., the game control device 810 or the physical level 814 can vibrate to indicate a back pat from another player or a game celebration, the indicators 806 can blink, etc.). The physical lever 814 can produce feelings in the lever to emulate a pulling feel or a vibration. The video projection device 824 can project video onto the props reels 808 so that the prop reels 808 can present many different types of wagering games. The prop reels 808 can spin when the physical lever 814 is pulled. The video projection device 824 can project reel icons onto the prop reels 808 as they spin. The video projection device 824 can also project reel icons onto the prop reels 808 when the prop reels 808 are stationary, but the imagery from the video project device 824 makes the prop reels 808 appear to spin. The magnetic card reader 804 can be used to swipe a credit card, a player card, or other cards, so that the system can quickly get information. The system 800 can offer lower rates for using the magnetic card reader 804 (e.g., to get a lower rate per transaction). The game control device 810 can include an emotion indicator keypad with keys 820 that a player can use to indicate emotions. The game control device 810 can also include biometric devices 821 such as a heart-rate monitor, an eye pupil dilation detector, a fingerprint scanner, a retinal scanner, voice detectors, speech recognition microphones, motion sensors, sound detectors, etc. The biometric devices 821 can be located in other places, such as in the headset 836, within a chair (not shown), within personal control devices (e.g. joysticks, remote controls, game pads, roller-balls, touch-pads, touch-screens, etc.), within the web-cam 835, or any other external device. The external devices can be connected to the computer 830 or to the game control device 810 via the input/output ports 818. As a security feature, some biometric devices can be associated with some of the gaming pad devices (e.g., the magnetic card reader 804), such as a fingerprint scanner, a retinal scanner, a signature pad to recognize a player's signature, etc. The game control device 810 can also use the keys 820 to share items and control avatars, icons, game activity, movement, etc. within a network wagering venue. The game pad can also have an electronic (e.g., digital) button panel 825, an electronic control panel 823, or any other type of changeable panel that can change appearance and/or configuration based on the game being played, the action being performed, and/or other activity presented within an online gaming venue. The game control device 810 can also move in different directions to control activity within the online gaming venue (e.g., movement of a player's avatar moves in response to the movements of the game control device 810). Avatars can be pre-programmed to act and look in certain ways, which the player can control using the system 800. The gaming pad 802 can permit the player to move the avatar fluidly and more easily than is possible using a standard keyboard. The system 800 can cause an avatar to respond to input that a player receives via the gaming pad 802. For example, a player may hear a sound that comes primarily from one direction (e.g., via stereophonic signals in the headset 836) within the network wagering venue. The system 800 can detect the movement of the player (e.g., the system 800 detects that a player moves his head to look in the direction of the sound, the player uses the game control device 810 to move the avatar's perspective to the direction of the sound, etc.). The system 800 can consequently move the avatar's head and/or the avatar's perspective in response to the player's movement. The player can indicate an expression of an emotion indicated by the player using the keys 820. The system 800 can make the avatar's appearance change to reflect the indicated emotion. The system 800 can respond to other movements or actions by the player and fluidly move the avatar to respond. The system 800 can also interpret data provided by the biometric devices and determine expressions and/or indications of emotions for a player using the system 800.

Wagering Game Machine Architecture

Figure 9:
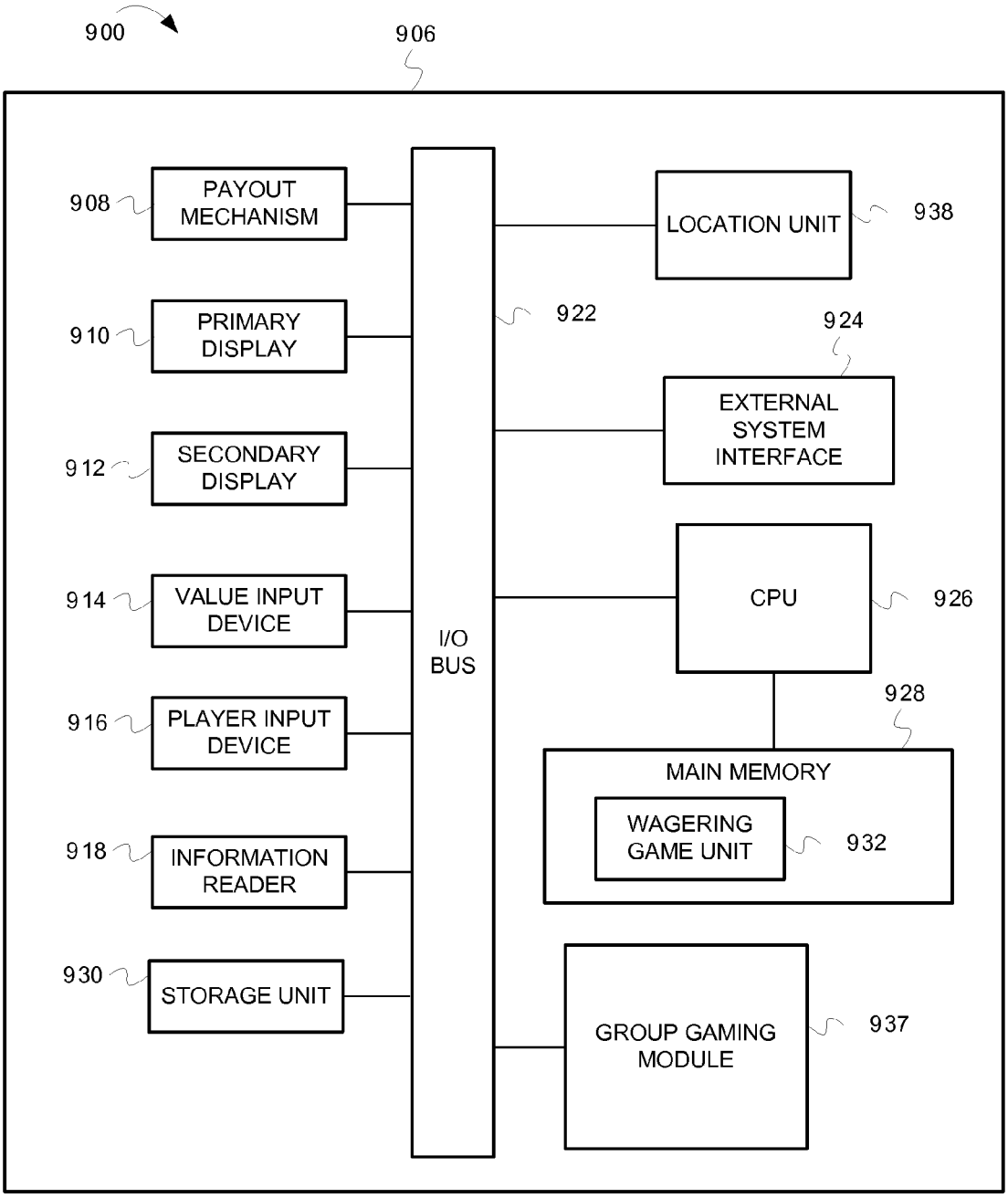
FIG. 9 is an illustration of a wagering game machine architecture 900, according to some embodiments.

FIG. 9 is a conceptual diagram that illustrates an example of a wagering game machine architecture 900, according to some embodiments. In FIG. 9, the wagering game machine architecture 900 includes a wagering game machine 906, which includes a central processing unit (CPU) 926 connected to main memory 928. The CPU 926 can include any suitable processor, such as an Intel® Pentium processor, Intel® Core 2 Duo processor, AMD Opteron™ processor, or UltraSPARC processor. The main memory 928 includes a wagering game unit 932. In some embodiments, the wagering game unit 932 can present wagering games, such as video poker, video black jack, video slots, video lottery, reel slots, etc., in whole or part.

The CPU 926 is also connected to an input/output ("I/O") bus 922, which can include any suitable bus technologies, such as an AGTL+frontside bus and a PCI backside bus. The I/O bus 922 is connected to a payout mechanism 908, primary display 910, secondary display 912, value input device 914, player input device 916, information reader 918, and storage unit 930. The player input device 916 can include the value input device 914 to the extent the player input device 916 is used to place wagers. The I/O bus 922 is also connected to an external system interface 924, which is connected to external systems (e.g., wagering game networks). The external system interface 924 can include logic for exchanging information over wired and wireless networks (e.g., 802.11g transceiver, Bluetooth transceiver, Ethernet transceiver, etc.)

The I/O bus 922 is also connected to a location unit 938. The location unit 938 can create player information that indicates the wagering game machine's location/movements in a casino. In some embodiments, the location unit 938 includes a global positioning system (GPS) receiver that can determine the wagering game machine's location using GPS satellites. In other embodiments, the location unit 938 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 9, in some embodiments, the location unit 938 is not connected to the I/O bus 922.

In some embodiments, the wagering game machine 906 can include additional peripheral devices and/or more than one of each component shown in FIG. 9. For example, in some embodiments, the wagering game machine 906 can include multiple external system interfaces 924 and/or multiple CPUs 926. In some embodiments, any of the components can be integrated or subdivided.

In some embodiments, the wagering game machine 906 includes a group gaming module 937. The group gaming module 937 can process communications, commands, or other information, where the processing can control group wagering games.

Furthermore, any component of the wagering game machine 906 can include hardware, firmware, and/or machine-readable media including instructions for performing the operations described herein.

Wagering Game Machine

Figure 10:
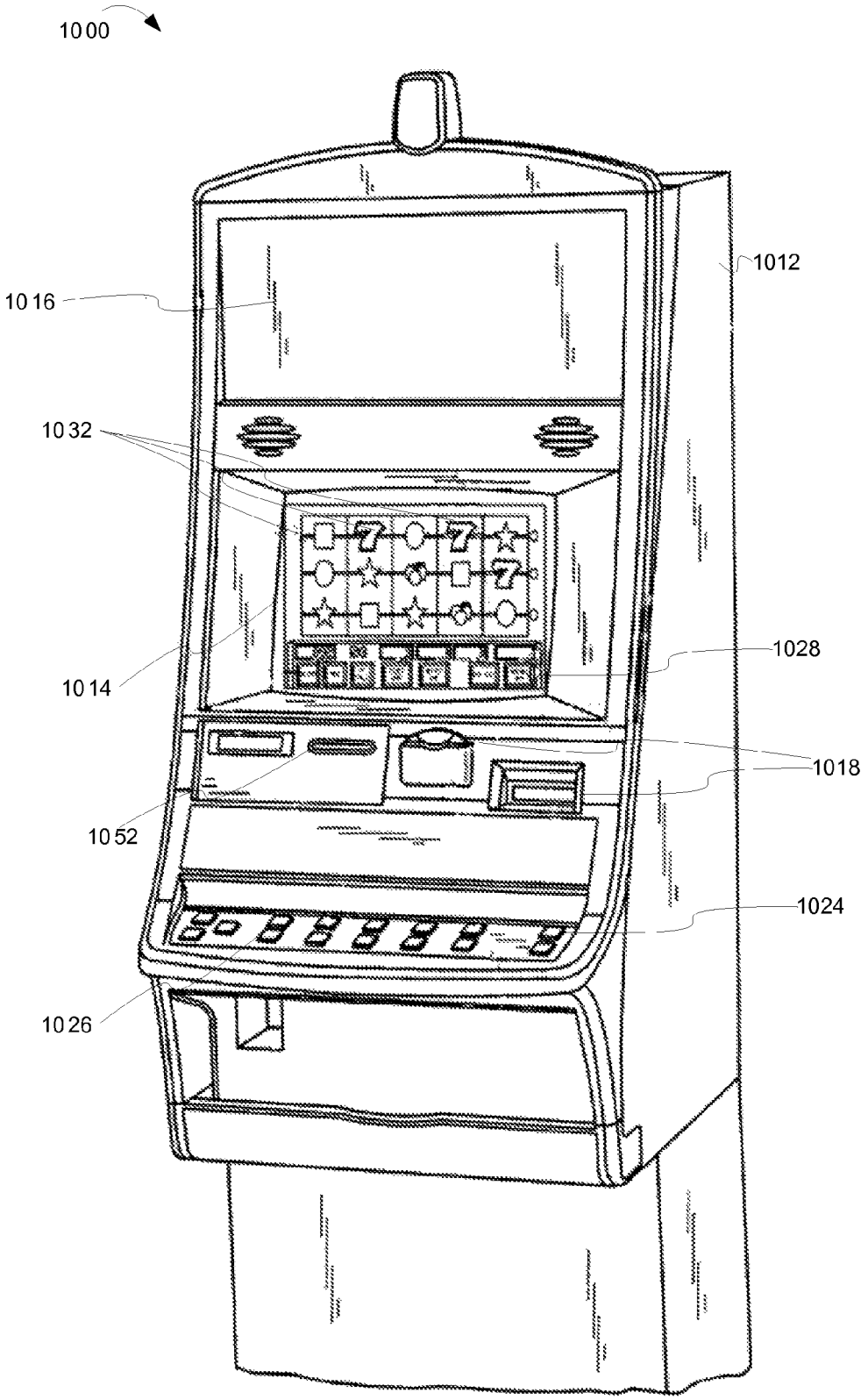
FIG. 10 is an illustration of a wagering game machine 1000, according to some embodiments.

FIG. 10 is a conceptual diagram that illustrates an example of a wagering game machine 1000, according to some embodiments. Referring to FIG. 10, the wagering game machine 1000 can be used in gaming establishments, such as casinos. According to some embodiments, the wagering game machine 1000 can be any type of wagering game machine and can have varying structures and methods of operation. For example, the wagering game machine 1000 can be an electromechanical wagering game machine configured to play mechanical slots, or it can be an electronic wagering game machine configured to play video casino games, such as blackjack, slots, keno, poker, blackjack, roulette, etc.

The wagering game machine 1000 comprises a housing 1012 and includes input devices, including value input devices 1018 and a player input device 1024. For output, the wagering game machine 1000 includes a primary display 1014 for displaying information about a basic wagering game. The primary display 1014 can also display information about a bonus wagering game and a progressive wagering game. The wagering game machine 1000 also includes a secondary display 1016 for displaying wagering game events, wagering game outcomes, and/or signage information. While some components of the wagering game machine 1000 are described herein, numerous other elements can exist and can be used in any number or combination to create varying forms of the wagering game machine 1000.

The value input devices 1018 can take any suitable form and can be located on the front of the housing 1012. The value input devices 1018 can receive currency and/or credits inserted by a player. The value input devices 1018 can include coin acceptors for receiving coin currency and bill acceptors for receiving paper currency. Furthermore, the value input devices 1018 can include ticket readers or barcode scanners for reading information stored on vouchers, cards, or other tangible portable storage devices. The vouchers or cards can authorize access to central accounts, which can transfer money to the wagering game machine 1000.

The player input device 1024 comprises a plurality of push buttons on a button panel 1026 for operating the wagering game machine 1000. In addition, or alternatively, the player input device 1024 can comprise a touch screen 1028 mounted over the primary display 1014 and/or secondary display 1016.

The various components of the wagering game machine 1000 can be connected directly to, or contained within, the housing 1012. Alternatively, some of the wagering game machine's components can be located outside of the housing 1012, while being communicatively coupled with the wagering game machine 1000 using any suitable wired or wireless communication technology.

The operation of the basic wagering game can be displayed to the player on the primary display 1014. The primary display 1014 can also display a bonus game associated with the basic wagering game. The primary display 1014 can include a cathode ray tube (CRT), a high resolution liquid crystal display (LCD), a plasma display, light emitting diodes (LEDs), or any other type of display suitable for use in the wagering game machine 1000. Alternatively, the primary display 1014 can include a number of mechanical reels to display the outcome. In FIG. 10, the wagering game machine 1000 is an "upright" version in which the primary display 1014 is oriented vertically relative to the player. Alternatively, the wagering game machine can be a "slant-top" version in which the primary display 1014 is slanted at about a thirty-degree angle toward the player of the wagering game machine 1000. In yet another embodiment, the wagering game machine 1000 can exhibit any suitable form factor, such as a free standing model, bar top model, mobile handheld model, or workstation console model.

A player begins playing a basic wagering game by making a wager via the value input device 1018. The player can initiate play by using the player input device's buttons or touch screen 1028. The basic game can include arranging a plurality of symbols along a pay line 1032, which indicates one or more outcomes of the basic game. Such outcomes can be randomly selected in response to player input. At least one of the outcomes, which can include any variation or combination of symbols, can trigger a bonus game.

In some embodiments, the wagering game machine 1000 can also include an information reader 1052, which can include a card reader, ticket reader, bar code scanner, RFID transceiver, or computer readable storage medium interface. In some embodiments, the information reader 1052 can be used to award complimentary services, restore game assets, track player habits, etc.

Embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments of the inventive subject matter may take the form of a computer program product embodied in any tangible medium of expression having computer readable program code embodied in the medium. The described embodiments may be provided as a computer program product, or software, that may include a machine-readable medium having stored thereon instructions, which may be used to program a computer system (or other electronic device(s)) to perform a process according to embodiments(s), whether presently described or not, because every conceivable variation is not enumerated herein. A machine readable medium includes any mechanism for storing or transmitting information in a form (e.g., software, processing application) readable by a machine (e.g., a computer). The machine-readable medium may include, but is not limited to, magnetic storage medium (e.g., floppy diskette); optical storage medium (e.g., CD-ROM); magneto-optical storage medium; read only memory (ROM); random access memory (RAM); erasable programmable memory (e.g., EPROM and EEPROM); flash memory; or other types of medium suitable for storing electronic instructions.

GENERAL

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A method of operating a wagering game server configured to generate one or more wagering game outcomes and provide one or more rewards for winning outcomes, said method comprising:

logging in a wagering game player account using login information received via a communications interface of the wagering game server, wherein the login information is transmitted via a communications network from a client device at a geographic location outside a casino, and wherein the wagering game server is external to the geographic location;

detecting, via the communications interface, an electronic request sent from the client device lo initiate a wagering game at the geographic location;

providing to the client device, by the communications interface via the communications network, wagering game content in response to the electronic request to initiate the wagering game;

detecting, via the communications interface, a first wager placed by the client device via the wagering game player account as a proxy for a first game participant device at the geographic location;

detecting, via the communications interface, a second wager placed by the client device via the wagering game player account as a proxy for a second game participant device at the geographic location;

transmitting, by the communications interface via the communications network, at least one of the one or more wagering game outcomes for the first wager and the second wager; and electronically transferring a first portion of money from the first wager and the second wager to the wagering game player account for compensation as the proxy for the first game participant device and as the proxy for the second game participant device.

2. The method of claim 1 further comprising:

before detecting the first wager and the second wager, associating a first sub-account of the wagering game player account to the first game participant device and a second sub-account of the wagering game player account to the second game participant device;

associating an a first electronic financial account for the first game participant device to the first sub-account in response to a first user input via the first game participant device;

associating a second electronic financial account for the second game participant device to the second sub-account in response to second user input via the second game participant device;

electronically transferring first funds from the first electronic financial account to the first sub-account;

electronically transferring second funds from the second electronic financial account to the second sub-account;

transacting the first wager using at least a portion of the first funds transferred to the first sub-account; and transacting the second wager using at least a portion of the second funds transferred to the second sub-account.

3. The method of claim 1 further comprising:

determining a revenue sharing percentage from a revenue sharing agreement between the wagering game player account and a game provider associated with the wagering game server; and splitting the first portion of the money from the first wager and the second wager between the wagering game player account and the game provider according to the revenue sharing percentage.

4. The method of claim 1 further comprising:

determining identifying information obtained from a personal mobile device at the geographic location;

determining from the identifying information an additional wagering game player account associated with the identifying information; and using the additional wagering game player account to perform additional wagers for the wagering game via player input from the personal mobile device.

5. The method of claim 1 further comprising:

holding a second portion of money from one or more of the first wager or the second wager for a progressive jackpot; and making one or more of the first game participant device or the second game participant device eligible to win the progressive jackpot in response to holding the second portion of money from the one or more of the first wager and the second wager.

6. the method of claim 1, wherein the wagering game player account is for an online wagering game website, wherein the wagering game content is for presentation of a group wagering game at the geographic location, wherein the first game participant device and the second game participant device participate in the group wagering game, and wherein the at least one of the one or more wagering game outcomes is for presentation via at least one electronic display device at the geographic location.

7. The method of claim 2, wherein the client device is a game controller at the geographic location, and wherein the first game participant device and the second game participant device are connected to the client device via a local network at the geographic location.

8. A wagering game server comprising:

at least one processor;

a communications interface configured to communicate via a first network;

a memory storage device configured to store instructions, which when executed by the at least one processor, cause the wagering game server to log in a first wagering game player account using login information received via the communications interface, wherein the login information is transmitted via the first network from a client device at a first geographic location outside a casino, and wherein the wagering game server is outside the first geographic location.

detect, via the communications interface, an electronic request sent from the client device to initiate a wagering game at the first geographic location, provide to the client device, by the communications interface via the first network, wagering game content in response to the electronic request to initiate the wagering game, transact, via the at least one processor, a first wager placed by the client device using the first wagering game player account as a proxy for a first game participant device connected to the client device via a second network at the first geographic location, transact, via the at least one processor, a second wager placed by the client device using the first wagering game player account as a proxy for a second game participant device connected to the client device via the second network, generate a wagering game outcome, wherein the wagering game server is configured to pay a reward when the wagering game outcome is a winning outcome, transmit, by the communications interface via the first network, a the wagering game outcome to the client device in response to the transacting the first wager and the second wager, electronically transfer a portion of money from the first wager to the first wagering game player account for compensation as the proxy for the first game participant device, and electronically transfer a portion of money from the second wager to the first wagering game player account for compensation as the proxy for the second game participant device.

9. The wagering game server of claim 8, wherein the memory storage device is configured to store instructions, which when executed by the at least one processor, cause the wagering game server to:

associate sub-accounts of the first wagering game player account to the first game participant device and the second game participant device before the first wager and the second wager is are transacted;

associate a first electronic financial account associated with the first game participant device to a first of the sub-accounts in response to first user input via the first game participant device;

associate a second electronic financial account associated with the second game participant device to a second of the sub-accounts in response to a second user input via the second game participant device;

electronically transfer first funds from the first electronic financial account to the first of the sub-accounts;

transact the first wager using the first funds transferred to the first of the sub-accounts; and transact the second wager using the second funds transferred to the second of the sub-accounts.

10. The wagering game server of claim 8, wherein the memory storage device is configured to store instructions, which when executed by the at least one processor, cause the wagering game server to:

determine a revenue sharing percentage from a revenue sharing agreement between the first wagering game player account and a game provider associated with the wagering game server; and split the first portion of the money between the first wagering game player account and the game provider according to the revenue sharing percentage.

11. The wagering game server of claim 8, wherein the memory storage device is configured to store instructions, which when executed by the at least one processor, cause the wagering game server to:

determine identifying information obtained from a personal mobile device at the first geographic location;

determine from the identifying information a second wagering game player account associated with the identifying information; and use the second wagering game player account to perform additional wagers for the wagering game via player input from the personal mobile device.

12. The wagering game server of claim 8, wherein the memory storage device is configured to store instructions, which when executed by the at least one processor, cause the wagering game server to:

hold a second portion of money from one or more of the first wager or the second wager for a progressive jackpot; and make one or more of the first game participant device and the second game participant device eligible for the progressive jackpot in response to holding the second portion of money from the one or more of the first wager and the second wager.

13. The wagering game server of claim 8, wherein the memory storage device is configured to store instructions, which when executed by the at least one processor, cause the wagering game server to:

detect, by the communications interface via the first network, an additional electronic request sent from an additional device at a second geographic location, to participate in the wagering game; and authorize a second wagering game player account associated with the additional device to make one or more additional wagers for the wagering game.

14. The wagering game server of claim 13, wherein the memory storage device is configured to store instructions, which when executed by the at least one processor, cause the wagering game server to:

control a competition via the wagering game content between the first wagering game player account and the second wagering game player account.

15. The wagering game server of claim 13, wherein the memory storage device is configured to store instructions, which when executed by the at least one processor, cause the wagering game server to:

detect a wagering jurisdictional rule for the second geographic location;

determine a wagering type permitted by the wagering jurisdictional rule; and cause the one or more additional wagers for the wagering game sent from the additional device to comply with the wagering type.

16. The wagering game server of claim 8, wherein the memory storage device is configured to store instructions, which when executed by the at least one processor, cause the wagering game server to:

detect a disconnection of the first game participant device from the second network at the first geographic location;

detect a connection, via the first network, of the first game participant device to the wagering game server when at a second geographic location outside the first geographic location;

provide the wagering game content to the first game participant device; and disable wagering capabilities on the first game participant device for the wagering game content in response to determining that the first game participant device is outside the first geographic location.

17. One or more non-transitory, machine-readable storage media having instructions stored thereon, which when executed by a set of one or more processors of a wagering game server cause the set of one or more processors to perform operations comprising:

logging in a first wagering game player account using login information received via a communications interface of the wagering game server, wherein the login information is transmitted via a communications network from a client device at a first geographic location outside a casino, and wherein the wagering game server is at a second geographic location different from the first geographic location;

detecting, via the communications interface, an electronic request sent from the first client device to initiate a wagering game at the first geographic location;

providing to the first client device, by the communications interface via the communications network, wagering game content in response to the electronic request to initiate the wagering game;

detecting, via the communications interface, a first wager placed by the client device, wherein the first wager originates from a first game participant device at the first geographic location;

detecting, via the communications interface, a second wager placed by the client device, wherein the second wager originates from a second game participant device at the first geographic location;

transacting the first wager via the first wagering game player account as a proxy account for the first game participant device;

transacting the second wager via the first wagering game player account as a proxy account for the second game participant device;

generating a wagering game outcome, wherein the wagering game server is configured to provide a reward when the wagering game outcome is a winning outcome;

transmitting, by the communications interface via the communications network, the wagering game outcome to the client device for the first wager and the second wager in response to the transacting the first wager and the second wager;

electronically transferring a portion of money from the first wager to the first wagering game player account for compensation as the proxy account for the first game participant device; and electronically transferring a portion of money from the first second to the first wagering game player account for compensation as the proxy account for the second game participant device.

18. The one or more non-transitory, machine-readable storage media of claim 17, said operations further comprising:

associating a first sub-account of the first wagering game player account to the first game participant device;

associating a second sub-account of the first wagering game player account to the second game participant device;

associating a first electronic financial account associated with the first game participant device to the first sub-account in response to a first user input via the first game participant device;

associating a second electronic financial account associated with the second game participant device to the second sub-account in response to a second user input via the second game participant device;

electronically transferring first funds from the first electronic financial account to the first sub-account in response to the detecting the first wager;

electronically transferring second funds from the second electronic financial account to the second sub-account in response to the detecting the second wager;

transacting the first wager using the first funds; and transacting the second wager using the second funds.

19. The one or more non-transitory, machine-readable storage media of claim 17, said operations further comprising:

determining a revenue sharing percentage from a revenue sharing agreement between the first wagering game player account and a game provider associated with the wagering game server; and splitting the first portion of the money between the first wagering game player account and the game provider according to the revenue sharing percentage.

20. The one or more non-transitory, machine-readable storage media of claim 17, said operations further comprising:

determining identifying information obtained from a personal mobile device at the first geographic location;

determining from the identifying information a second wagering game player account associated with the identifying information; and using the second wagering game player account to perform additional wagers for the wagering game via player input from the personal mobile device.

21. The one or more non-transitory, machine-readable storage media of claim 17, said operations further comprising:

holding a second portion of money from the one or more of the first wager or the second wager for a progressive jackpot; and making one or more of the first game participant device and the second game participant device eligible to win the progressive jackpot in response to holding the second portion of money from the one or more of the first wager or the second wager.

22. The one or more non-transitory, machine-readable storage media of claim 17, said operations further comprising:

determining branding graphics stored with the first wagering game player account, wherein the branding graphics identify a business identifier associated with the first geographic location; and providing the branding graphics, via the communications network, to the client device to present with the wagering game content.

23. The one or more non-transitory, machine-readable storage media of claim 17, said operations further comprising:

detecting a triggering event that occurs at the first geographic location;

selecting one of a plurality of sections at the first geographic location in response to the detecting the triggering event, wherein each of the plurality of sections includes a set of game participant devices; and enabling wagering on game participant devices in the one of the plurality of sections in response to the selecting of the one of the plurality of sections.

* * * * *